US010054088B2

(12) United States Patent
Niwa et al.

(10) Patent No.: US 10,054,088 B2
(45) **Date of Patent: *Aug. 21, 2018**

(54) FUEL SUPPLY DEVICE

(71) Applicants: DENSO CORPORATION, Kariya, Aichi-pref. (JP); KYOSAN DENKI CO., LTD., Koga, Ibaraki-pref. (JP)

(72) Inventors: Yutaka Niwa, Kariya (JP); Hideto Takahashi, Kariya (JP); Tetsuro Okazono, Kariya (JP); Hironobu Oki, Koga (JP); Akihiro Ishitoya, Koga (JP); Akinari Sugiyama, Koga (JP)

(73) Assignees: DENSO CORPORATION, Kariya (JP); KYOSAN DENKI CO., LTD., Koga (JP)

( * ) Notice: Subject to any disclaimer, the term of this patent is extended or adjusted under 35 U.S.C. 154(b) by 166 days.

This patent is subject to a terminal disclaimer.

(21) Appl. No.: 15/031,136

(22) PCT Filed: Nov. 3, 2014

(86) PCT No.: PCT/JP2014/005533

§ 371 (c)(1),
(2) Date: Apr. 21, 2016

(87) PCT Pub. No.: WO2015/068372

PCT Pub. Date: May 14, 2015

(65) Prior Publication Data

US 2016/0252060 A1 Sep. 1, 2016

(30) Foreign Application Priority Data

Nov. 5, 2013 (JP) ..... 2013-229596
Aug. 29, 2014 (JP) ..... 2014-175189

(51) Int. Cl.
*F02M 37/10* (2006.01)
*F02M 37/02* (2006.01)
(Continued)

(52) U.S. Cl.
CPC ..... *F02M 37/106* (2013.01); *F02M 37/025* (2013.01); *F02M 37/22* (2013.01);
(Continued)

(58) Field of Classification Search
CPC ..... F02M 2037/225; F02M 2037/226; F02M 37/0011; F02M 37/0023; F02M 37/0029; F02M 37/14
See application file for complete search history.

(56) References Cited

U.S. PATENT DOCUMENTS 5,613,476 A * 3/1997 Oi ..... B01D 35/0273 123/509
6,142,126 A 11/2000 Kanamaru
(Continued)

FOREIGN PATENT DOCUMENTS

JP 11-294286 10/1999
JP 2000-120503 4/2000
(Continued)

OTHER PUBLICATIONS

Niwa, U.S. Appl. No. 15/031,094, entitled "Fuel Supply Device", filed Apr. 21, 2016.
(Continued)

*Primary Examiner* — Sizo Vilakazi
*Assistant Examiner* — Kevin R Steckbauer
(74) *Attorney, Agent, or Firm* — Nixon & Vanderhye PC

(57) ABSTRACT

A fuel supply device includes a fuel pump, a filter case that houses a fuel filter, and a port member joined to the filter case, a fuel pumped by the fuel pump from inside a fuel tank is filtered by the fuel filter and supplied from inside the filter
(Continued)

case toward an internal combustion engine, and the port member integrally includes a plurality of fuel ports that communicate from inside of the filter case to outside of the filter case.

13 Claims, 23 Drawing Sheets

(51) Int. Cl.
*F02M 37/22* (2006.01)
*F02M 37/00* (2006.01)
*F02M 37/14* (2006.01)
*F02M 37/08* (2006.01)

(52) U.S. Cl.
CPC ..... *F02M 37/0023* (2013.01); *F02M 37/0029* (2013.01); *F02M 37/14* (2013.01); *F02M 2037/087* (2013.01); *F02M 2037/225* (2013.01); *F02M 2037/226* (2013.01)

(56) References Cited

U.S. PATENT DOCUMENTS 6,520,163 B2 * 2/2003 Yoshioka ..... B01D 35/027 123/510
7,316,222 B2 * 1/2008 Danjyo ..... F02M 37/0094 123/509
7,363,917 B2 * 4/2008 Kramer ..... B01D 29/606 123/457
7,631,634 B2 * 12/2009 Ramamurthy ..... F02M 37/0017 123/459
7,757,671 B2 * 7/2010 Danjo ..... F02M 37/106 123/509
9,115,713 B2 * 8/2015 Oikawa ..... F02M 59/44
9,429,118 B2 * 8/2016 Oohashi ..... F02M 37/04
9,546,624 B2 * 1/2017 Honda ..... F02M 37/0088
9,567,953 B2 * 2/2017 Oohashi ..... F02M 37/0088
9,567,956 B2 * 2/2017 Oohashi ..... B60K 15/03
9,574,530 B2 * 2/2017 Oohashi ..... F02M 37/0088
9,745,929 B2 * 8/2017 Oohashi ..... F02M 37/0088
2001/0027779 A1 10/2001 Iwai et al.
2002/0026927 A1 * 3/2002 Yoshioka ..... B01D 35/027 123/510
2003/0094161 A1 5/2003 Suzuki et al.
2004/0020839 A1 2/2004 Kato et al.
2007/0079813 A1 * 4/2007 Kramer ..... B01D 29/606 123/511
2007/0209641 A1 * 9/2007 Danjyo ..... F02M 37/0094 123/495
2009/0013970 A1 * 1/2009 Danjo ..... F02M 37/106 123/509
2009/0120413 A1 * 5/2009 Ramamurthy ..... F02M 37/0017 123/511
2011/0247488 A1 * 10/2011 Oikawa ..... F02M 59/44 92/144
2015/0059705 A1 * 3/2015 Oohashi ..... F02M 37/0088 123/505
2015/0059706 A1 * 3/2015 Oohashi ..... F02M 37/0088 123/506
2015/0059707 A1 * 3/2015 Oohashi ..... F02M 37/04 123/509
2015/0059708 A1 * 3/2015 Oohashi ..... F02M 37/0088 123/509
2015/0059709 A1 * 3/2015 Oohashi ..... B60K 15/03 123/509
2015/0224873 A1 * 8/2015 Ishitoya ..... F02M 37/025 123/509
2015/0361936 A1 * 12/2015 Honda ..... F02M 37/0088 123/495
2016/0245246 A1 * 8/2016 Niwa ..... F02M 37/106
2016/0252059 A1 * 9/2016 Niwa ..... F02M 37/22 137/544
2016/0265494 A1 * 9/2016 Niwa ..... F02M 37/22
2017/0030358 A1 * 2/2017 Fischer ..... H02K 5/12
2017/0254302 A1 * 9/2017 Takahashi ..... F02M 37/18
2017/0254303 A1 * 9/2017 Takahashi ..... F02M 37/18
2017/0292481 A1 * 10/2017 Fukuoka ..... F02M 37/0023
2017/0314522 A1 * 11/2017 Takahashi ..... F02M 37/106

FOREIGN PATENT DOCUMENTS

JP 2012-097640 5/2012
JP 2012097640 A * 5/2012 ..... F02M 37/00

OTHER PUBLICATIONS

Niwa, U.S. Appl. No. 15/031,090, entitled "Fuel Supply Device", filed Apr. 21, 2016.
Niwa, U.S. Appl. No. 15/031,084, entitled "Fuel Supply Device", filed Apr. 21, 2016.

* cited by examiner

FUEL SUPPLY DEVICE

CROSS-REFERENCE TO RELATED APPLICATIONS

The present application is the U.S. national phase of International Application No. PCT/JP2014/005533 filed Nov. 3, 2014 which designated the U.S. and claims priority to Japanese patent applications No. 2013-229596 filed on Nov. 5, 2013, and No. 2014-175198 filed on Aug. 29, 2014, the entire contents of each of which are incorporated herein by reference.

TECHNICAL FIELD

The present disclosure relates to a fuel supply device that supplies fuel in a fuel tank toward an internal combustion engine.

BACKGROUND ART

Conventionally, a fuel, which is pumped by a fuel pump from inside a fuel tank, is filtered by a fuel filter inside a filter case and supplied from the same case toward an internal combustion engine by a fuel supply device, which is widely used by being mounted in a vehicle.

Patent Literature 1 discloses a device as one kind of such a fuel supply device, in which a plurality of fuel ports, which are in communication from inside of a filter case to outside of the same case, are integrally formed in the same case.

PRIOR ART LITERATURE

Patent Literature

Patent Literature 1: JP 2007-239682 A

SUMMARY OF THE INVENTION

According to the device disclosed by Patent Literature 1, when integrally forming the fuel ports at a plurality of locations of the filter case, each time the forming locations of these ports are changed according to specification, the construction of the filter case must also change. In particular, the filter case must prioritize ensuring a housing location for a fuel filter that filters fuel. Given this priority, there is a concern that trying to ensure the forming location of each fuel port may complicate the structure of the case and reduce productivity.

In view of the above points, it is an object of the present disclosure to improve productivity in a fuel supply device where the inside of a filter case is in communication with outside of the filter case through a plurality of fuel ports.

In a first disclosure, a fuel supply device includes a fuel pump, a filter case that houses a fuel filter, and a port member joined to the filter case, where a fuel pumped by the fuel pump from inside a fuel tank is filtered by the fuel filter and supplied from inside the filter case toward an internal combustion engine, and the port member integrally includes a plurality of fuel ports that communicate from inside of the filter case to outside of the filter case.

According to such a first disclosure, the port member which integrally includes the plurality of ports is joined to the filter case, and thereby these fuel ports communication from inside to outside of the same case. Accordingly, while prioritizing ensuring a forming location in the filter case for the fuel filter which is suitable for filtering fuel, the ensuring of forming locations for each fuel port may be separated form the same case. As a result, the port member, which is specialized in ensuring a forming location for each fuel port, is joined to the filter case, which has a simplified structure, and a fuel supply device may be manufactured according to specification. Accordingly, the productivity of the fuel supply device may be improved.

Accordingly to a second disclosure, the filter case and the port member are joined to each other on a common imaginary plane.

As in the second disclosure, by implementing the joining of the filter case and the port member on the common imaginary plane, not only is the joining operation simplified, but it is difficult for joining defects to occur. Accordingly, along with the productivity of the fuel supply device, the yield rate thereof may be improved as well.

According to a third disclosure, the port member forms, as one of the fuel ports, a discharge port that discharges fuel in the filter case toward the internal combustion engine outside the filter case, the filter case has disposed therein a fuel passage including a communication port, the communication port being in communication with a housing chamber in the filter case, which houses the fuel filter, at a location downstream from the fuel filter, the fuel passage allowing fuel to flow from the communication port, an external residual pressure retention valve having a valve element that, when the fuel pump is operating, opens and becomes locked by a valve stopper, the external residual pressure retention valve being a spring-less type external residual pressure retention valve that, when the fuel pump is stopped, retains a pressure of the fuel supplied toward the internal combustion engine due to being discharged from the discharge port, and an internal residual pressure retention valve having a valve element that, when the fuel pump is operating, resists a spring reaction force to open, the internal residual pressure retention valve being a spring-biased type residual pressure retention valve that, when the fuel pump is stopped, retains a pressure of the fuel in the housing chamber, the communication port opens at an offset location in the fuel passage, the offset location being offset from the internal residual pressure retention valve toward the external residual pressure retention valve, the fuel passage has formed therein an external passage portion that allows fuel, which is for being discharged by the discharge port toward the internal combustion engine, to flow from the communication port toward the external residual pressure retention valve, and an internal passage portion that allows fuel to flow from the communication port toward the internal residual pressure retention valve, the internal passage portion narrowing down a fuel flow more than the external passage portion, and when a passage cross-sectional area of the internal passage portion is converted into a passage cross-sectional area of a cylindrical pipe, a passage diameter D of this cylindrical pipe and a length L of the internal passage portion satisfy the equation $L/D \geq 3$.

According to the third disclosure, the external residual pressure retention valve is a spring-less type that includes a valve element which, due to the fuel pump operating, opens and is locked by the valve stopper. For this reason, even if pressure oscillations are generated due to the fuel pump pumping fuel, it is difficult for the locked valve element to vibrate.

Further according to the third disclosure, the internal residual pressure retention valve is a spring-biased type that includes the valve element which, due to the fuel pump operating, resists the spring reaction force and opens. Here, in the fuel passage which allows discharge fuel to flow from the discharge port to the internal combustion engine, the communication port, which is in communication with the housing chamber at a location downstream from the fuel filter, opens at the location which is a position offset from the internal residual pressure retention valve toward the external residual pressure retention valve. Due to this, in the fuel passage, the length L of the internal passage portion, which narrows down a fuel flow from the communication port toward the internal residual pressure retention valve more than as compared to the external passage portion in which fuel flows from the communication port toward the external residual pressure retention valve, may be increased so as to satisfy the above equation $L/D \geq 3$. As a result, the pressure oscillations generated due to the fuel pumping from the fuel pump may be attenuated at the internal passage portion which is long and narrowed down until toward the spring-biased type internal residual pressure retention valve. Accordingly, the vibrations of the valve element in this internal residual pressure retention valve may also be attenuated.

Due to the above according to the third disclosure, in either of the external residual pressure retention valve and the internal residual pressure retention valve, pressure oscillations may be suppressed from increasing due to vibrations of the valve elements. Accordingly, noise generated in the path from the fuel passage until the internal combustion engine may be reduced.

According to a fourth disclosure, the port member forms, as one of the fuel ports, a discharge port that discharges fuel in the filter case toward the internal combustion engine outside the filter case, the filter case has disposed therein a fuel passage including a communication port, the communication port being in communication with a housing chamber in the filter case, which houses the fuel filter, at a location downstream from the fuel filter, the fuel passage allowing fuel to flow from the communication port, a discharge passage in communication with the discharge port to discharge fuel flowing in the fuel passage toward the internal combustion engine, an internal residual pressure retention valve having a valve element that, when the fuel pump is operating, resists a spring reaction force to open, the internal residual pressure retention valve being a spring-biased type residual pressure retention valve that, when the fuel pump is stopped, retains a pressure of the fuel in the housing chamber, the communication port opens at an offset location in the fuel passage, the offset location being offset from the internal residual pressure retention valve toward the discharge passage, the fuel passage has formed therein an external passage portion that allows fuel to flow from the communication port toward the discharge passage, and an internal passage portion that allows fuel to flow from the communication port toward the internal residual pressure retention valve, the internal passage portion narrowing down a fuel flow more than the external passage portion, and when a passage cross-sectional area of the internal passage portion is converted into a passage cross-sectional area of a cylindrical pipe, a passage diameter D of this cylindrical pipe and a length L of the internal passage portion satisfy the equation $L/D \geq 3$.

According to the fourth disclosure, the internal residual pressure retention valve is a spring-biased type including the valve element, which resists a spring reaction force to open when the fuel pump is operating. Here, in the fuel passage which allows discharge fuel from the discharge port, which is in communication with the discharge passage, to flow toward the internal combustion engine, the communication port, which is in communication with the housing chamber at a location downstream from the fuel filter, opens at the offset location, which is a location offset from the internal residual pressure retention valve toward this discharge passage. Accordingly, in the fuel passage, the length L of the internal passage portion, which narrows down a fuel flow from the communication port toward the internal residual pressure retention valve more than as compared to the external passage portion in which fuel flows from the communication port toward the discharge passage, may be increased as compared so as to satisfy the above equation $L/D \geq 3$. As a result, the pressure oscillations generated due to the fuel pumping from the fuel pump may be attenuated at the internal passage portion which is long and narrowed down until toward the spring-biased type internal residual pressure retention valve. Accordingly, the vibrations of the valve element in this internal residual pressure retention valve may also be attenuated.

Due to the above according to the fourth disclosure, in the internal residual pressure retention valve, it is possible to suppress pressure oscillations from increasing due to vibrations of the valve element. Accordingly, noise generated in the path from the fuel passage until the internal combustion engine may be reduced.

EMBODIMENTS FOR CARRYING OUT INVENTION

Figure 1:
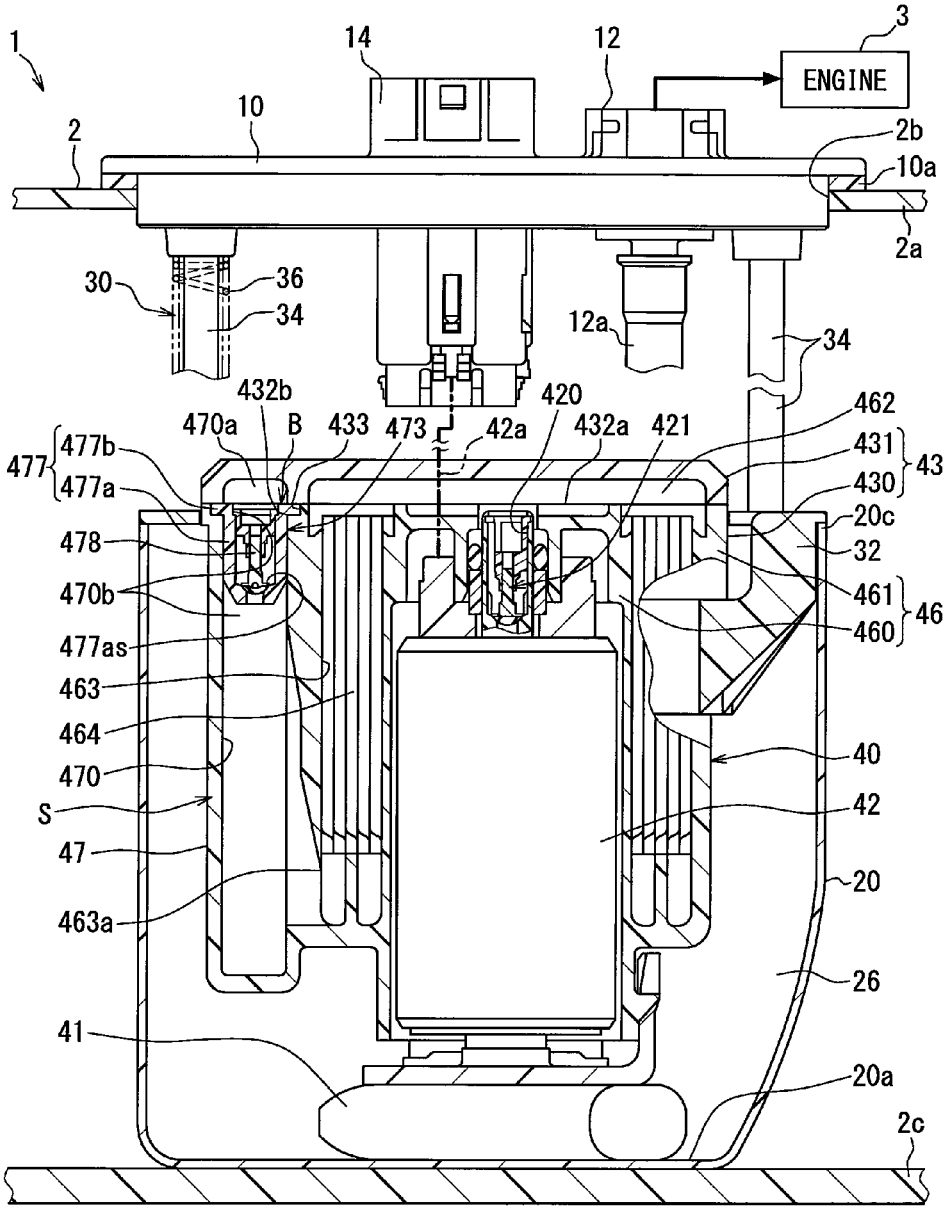
FIG. 1 is a view showing a fuel supply device according to a first embodiment, and is a cross-sectional view along I-I of FIG. 3.

Next, a plurality of embodiments of the present disclosure will be explained with reference to the figures. Corresponding portions of each embodiment are denoted with the same reference numerals, and overlapping explanations may be omitted for brevity. If only a portion of the configuration of an embodiment is described, the configurations of previously described embodiments may be applied to the other portions of this configuration. The embodiments are not limited to combinations of portions which are specifically stated as being combinable. Instead, even without being stated, portions of embodiments may be combined with each other provided that no particular problem occurs for those combinations.

First Embodiment

Figure 2:
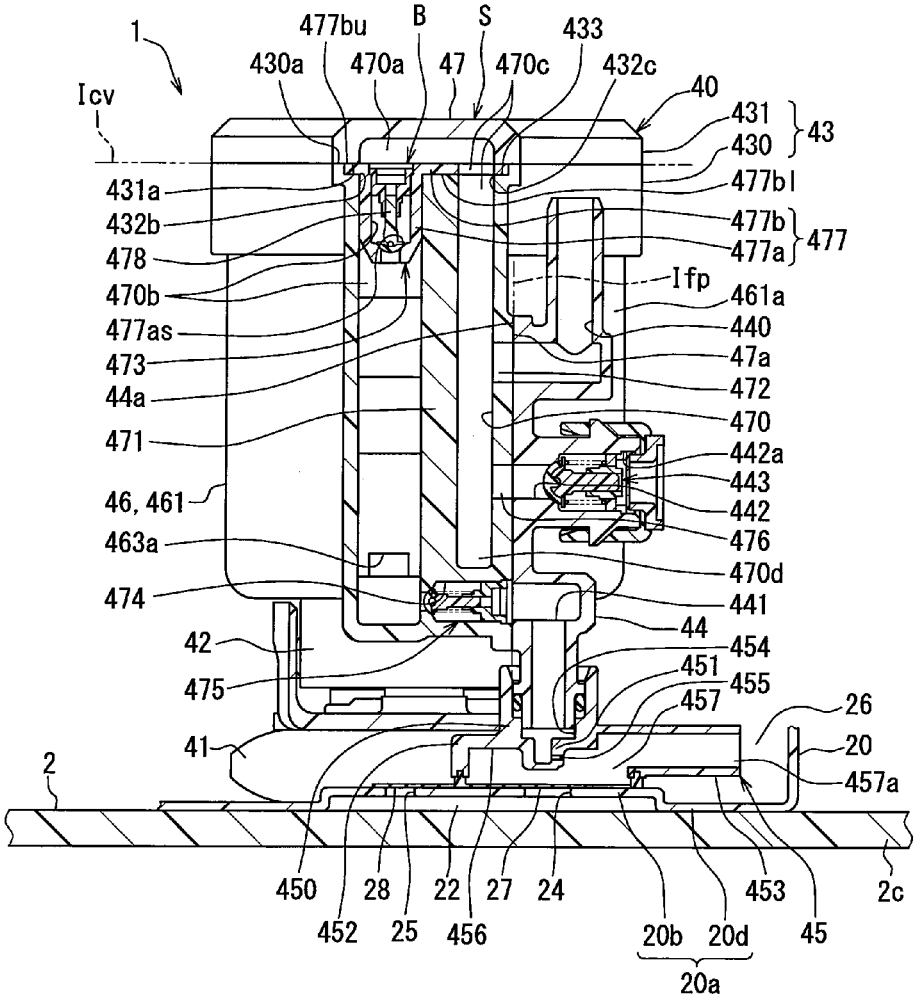
FIG. 2 is a view showing a pump unit of FIG. 1, and is a cross-sectional view along II-II of FIG. 3.

As shown in FIGS. 1 and 2, a fuel supply device 1 according to a first embodiment of the present disclosure is mounted in a fuel tank 2 of a vehicle. The device 1 supplies, directly or indirectly through a high pressure pump etc., fuel inside the fuel tank 2 to fuel injection valves of an internal combustion engine 3. Here, the fuel tank 2 equipped with the device 1 is formed from resin or metal in a hollow shape, and stores fuel to be supplied to the internal combustion engine 3. Further, the engine 3 to which the device 1 supplies fuel may be a gasoline engine, or may be a diesel engine. In addition, the up and down direction of the device 1 shown in FIGS. 1 and 2 substantially matches the up and down direction of the vehicle when the vehicle is on a level surface.

(Configuration and Operation)

Next, the configuration and operation of the device 1 will be explained.

Figure 3:
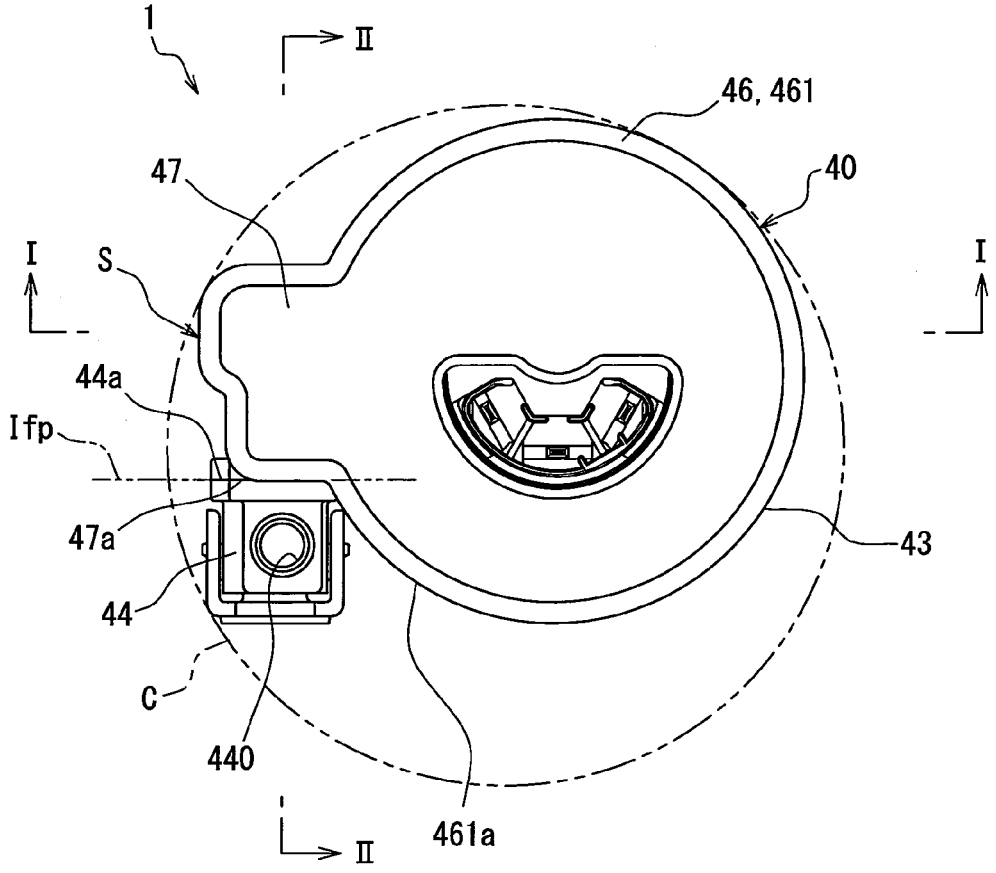
FIG. 3 is a plane view showing a pump unit of FIG. 1.

As shown in FIGS. 1 to 3, the device 1 includes a flange 10, a subtank 20, a regulating mechanism 30, and a pump unit 40.

As shown in FIG. 1, the flange 10 is formed by resin in a disc shape, and is mounted in a top plate portion 2*a* of the fuel tank 2. A gasket 10*a* is interposed between the flange 10 and the top plate portion 2*a* to close a throughhole 2*b* formed in the top plate portion 2*a*. The flange 10 integrally includes a fuel supply pipe 12 and an electrical connector 14.

The fuel supply pipe 12 protrudes in both the up and down directions from the flange 10. The fuel supply pipe 12 is in communication with the pump unit 40 through a flexible tube 12*a* that is bendable. Due to this communication, fuel pumped from inside the fuel tank 2 by a fuel pump 42 included in the pump unit 40 is supplied by the fuel supply pipe 12 to outside the fuel tank 2 and toward the internal combustion engine 3. The electrical connector 14 also protrudes in both the up and down directions from the flange 10. The electrical connector 14 electrically connects the fuel pump 42 with an external circuit, which is not illustrated. Due to this electrical connection, the fuel pump 42 is controlled by the external circuit.

As shown in FIGS. 1 and 2, the subtank 20 is formed by resin in a cylindrical shape having a closed bottom, and is housed in the fuel tank 2. A bottom portion 20*a* of the subtank 20 is mounted on a bottom portion 2*c* of the fuel tank 2. Here, as shown in FIG. 2, the bottom portion 20*a* includes a recessed bottom portion 20*b* that is indented upward. The recessed bottom portion 20*b* maintains a flow space 22 between the bottom portion 2*c*. In addition, flow inlets 24, 25 are formed in the recessed bottom portion 20*b*. The flow inlets 24, 25 are in communication with the inside of the fuel tank 2 through the flow space 22. Due to this communication, one flow inlet 24 allows fuel, which is transferred from inside the fuel tank 2 by a jet pump 45 of the pump unit 40, to flow into the subtank 20. Further, when the fuel tank 2 is empty and is refueled, the other flow inlet 25 allows fuel supplied into the fuel tank 2 to flow into the subtank 20. The fuel that flows through the flow inlets 24, 25 in this manner is stored in an interior space 26 (also refer to FIG. 1) of the subtank 20 that surrounds the fuel pump 42.

Further, a reed valve 27 and a reed valve 28 are disposed on the recessed bottom portion 20*b* of the present embodiment. The reed valve 27 opens the flow inlet 24 when the jet pump 45 applies a negative pressure, as will be explained later. The reed valve 28 opens the flow inlet 25 when a refueling pressure is applied.

As shown in FIG. 1, the regulating mechanism 30 includes a retaining member 32, a pair of columns 34, an elastic member 36, and the like.

The retaining member 32 is formed by resin in a torus shape, and is mounted to a top portion 20*c* of the subtank 20 in the fuel tank 2. Each column 34 is formed by metal in a cylindrical shape, is housed within the fuel tank 2, and extends in the up and down direction. The top end portion of each column 34 is fixed to the flange 10. Below these top end portions, each column 34 is inserted into the subtank 20, and is slidably guided by the retaining member 32 in the up and down direction.

The elastic member 36 is formed by metal in a coiled spring shape, and is housed within the fuel tank 2. The elastic member 36 is disposed coaxially about a corresponding one of the columns 34. The elastic member 36 is interposed between the corresponding column 34 and the retaining member 32 in the up and down direction. Due to being interposed, the elastic member 36 presses, through the retaining member 32, the bottom portion 20*a* of the subtank 20 toward the bottom portion 2*c* of the fuel tank 2.

As shown in FIGS. 1 and 2, the pump unit 40 is housed within the fuel tank 2. The pump unit 40 includes a suction filter 41, the fuel pump 42, a filter case 43, a port member 44, the jet pump 45, and the like.

The suction filter 41 may be, for example, a non-woven fabric filter, and is mounted on the bottom portion 20*a* in the subtank 20. The suction filter 41 filters fuel sucked from the internal space 26 of the subtank 20 by the fuel pump 42, thereby removing large foreign matter from this sucked fuel.

The fuel pump 42 is disposed in the subtank 20 above the suction filter 41. The entirety of the fuel pump 42 is cylindrical shaped. An axial direction of the fuel pump 42 substantially coincides with the up and down direction. In the present embodiment, the fuel pump 42 is an electric type pump. As shown in FIG. 1, the fuel pump 42 is electrically connected to the electrical connector 14 through the bendable flexible wire 42*a*. The fuel pump 42 is operated by receiving a driving control from the external circuit through the electrical connector 14. Here, when the fuel pump 42 is in operation, the fuel pump 42 sucks the fuel stored in its vicinity through the suction filter 41, and then regulates the pressure of this sucked fuel by pressurizing the sucked fuel in an inner portion.

The fuel pump 42 includes a delivery valve 421 that is integral with a delivery port 420 that delivers fuel. In the present embodiment, the delivery valve 421 is a spring-less type check valve. While the fuel pump 42 is operating and fuel is being pressurized, the delivery valve 421 opens. During this open period, fuel is pumped from the delivery port 420 into the filter case 43. Meanwhile, when the fuel pump 42 is stopped and fuel is not being pressurized, the delivery valve 421 closes. During this closed period, the delivery of fuel into the filter case 43 also stops.

As shown in FIGS. 1 and 2, the filter case 43 is formed by resin in a hollow shape, and is positioned to span across the inside and outside of the subtank 20 in the up and down direction. The filter case 43 is retained by the retaining member 32, and is thereby positioned with respect to the subtank 20.

A housing portion 46 of the filter case 43 is formed in a double cylindrical shape from an inner cylindrical portion 460 and an outer cylindrical portion 461. The housing portion 46 is coaxially disposed around the fuel pump 42. Due to the placement of the housing portion 46, the axial direction of the filter case 43 lies along the up and down direction. As shown in FIG. 1, the housing portion 46 forms a communication chamber 462 as a flat shaped room. The communication chamber 462 communicates the upper portion of the inner cylindrical portion 460 and the outer cylindrical portion 461 with the delivery port 420. Further, the housing portion 46 forms a housing chamber 463 as a cylindrical shaped hole. The housing chamber 463 communicates with the communication chamber 462 between the inner cylindrical portion 460 and the outer cylindrical portion 461. A cylindrical shaped fuel filter 464 is housed within the housing chamber 463. The fuel filter 464 may be, for example, a honeycomb filter or the like. The fuel filter 464 filters pressurized fuel delivered from the delivery port 420 through the communication chamber 462 to the housing chamber 463, thereby removing fine foreign matter from this pressurized fuel.

As shown in FIGS. 1 to 3, a protruding portion 47 of the filter case 43 protrudes radially outward from the outer cylindrical portion 461 toward a specific location S in the circumferential direction. As shown in FIGS. 1 and 2, the protruding portion 47 houses a fuel passage 470, a partition wall 471, a discharge passage 472, an external residual pressure retention valve 473, a branch passage 474, an internal residual pressure retention valve 475, and a relief passage 476. In other words, the protruding portion 47 integrally includes these elements 470, 471, 472, 473, 474, 475, 476 leaning toward the specific location S in the circumferential direction.

The fuel passage 470 is formed in the protruding portion 47 as a space that extends in a reverse U-shape. The fuel passage 470 is partitioned by the partition wall 471, and folds back in the axial direction of the filter case 43 along the up and down direction. In particular, the fuel passage 470 is partitioned into a straight line shape by the flat board belt shaped partition wall 471. According to such a partitioned fuel passage 470, each of an upstream straight portion 470*b* and a downstream straight portion 470*c* extend downward from either end of a turning back portion 470*a*. The turning back portion 470*a* is at the topmost position. The upstream straight portion 470*b* and the downstream straight portion 470*c* extend in a straight, substantially rectangular hole shape. In other words, the fuel passage 470 is formed of the turning back portion 470*a*, the upstream straight portion 470*b* which is upstream from the turning back portion 470*a*, and the downstream straight portion 470*c* which is downstream from the turning back portion 470*a*.

As shown in FIGS. 1 and 2, the upstream straight portion 470*b* is in communication with a fuel outlet 463*a* of the housing chamber 463. Accordingly, the fuel passage 470 is positioned downstream from the fuel filter 464. By being positioned in this manner, the fuel passage 470 allows pressurized fuel, which was filtered by the fuel filter 464 and output through the fuel outlet 463*a*, to flow toward a most-downstream end 470*d* of the downstream straight portion 470*c*.

As shown in FIG. 2, the discharge passage 472 is formed in a cylindrical shape at a central portion of the protruding portion 47 in the up and down direction. The discharge passage 472 branches from the downstream straight portion 470*c*, which is downstream of the fuel outlet 463*a* in the fuel passage 470, in a direction perpendicular to the axial direction of the filter case 43. The discharge passage 472 is in communication with a discharge port 440 of the port member 44. Accordingly, the discharge passage 472 discharges the fuel flowing in the fuel passage 470 through the flexible tube 12*a* and the fuel supply pipe 12 (refer to FIG. 1) toward the internal combustion engine 3. At this time in the fuel passage 470, fuel is diverted from the flow through the discharge passage 472 toward the internal combustion engine 3. This diverted fuel flows downstream of the discharge passage 472.

The external residual pressure retention valve 473 is disposed in the upstream straight portion 470*b* which is upstream from the discharge passage 472. Further, the external residual pressure retention valve 473 is disposed downstream from the fuel outlet 463*a*. In other words, the external residual pressure retention valve 473 is disposed at an intermediate portion in the fuel passage 470, between the fuel outlet 463*a* and the discharge passage 472.

In the present embodiment, the external residual pressure retention valve 473 is a spring-less type check valve. The external residual pressure retention valve 473 opens and closes the fuel passage 470 that includes the upstream straight portion 470*b*. Accordingly, the external residual pressure retention valve 473 functions as one of "a plurality of opening and closing valves". During a period when the fuel pump 42 is operating and pressurized filtered fuel is output from the fuel outlet 463*a*, the external residual pressure retention valve 473 opens. During this open period, the pressured fuel output into the fuel passage 470 flows toward the discharge passage 472 and the most-downstream end 470*d*. Meanwhile, during a period when the fuel pump 42 is stopped and fuel output from the fuel outlet 463*a* is stopped, the external residual pressure retention valve 473 closes. During this closed period, the flow of fuel toward the discharge passage 472 and the most-downstream end 470*d* stops. Accordingly, the pressure of the fuel discharged from the discharge passage 472 toward the internal combustion engine 3 before the external residual pressure retention valve 473 closed is maintained. In other words, due to the closed external residual pressure retention valve 473, a residual pressure retention function is exerted on the fuel supplied through the fuel passage 470 toward the internal combustion engine 3. In addition, the retained pressure due to the residual pressure retention function of the external residual pressure retention valve 473 is a pressure which is regulated when the fuel pump 42 is stopped.

Due to the above configuration, the fuel passage 470 is configured to communicate toward the internal combustion engine 3 through the external residual pressure retention valve 473 and the discharge passage 472. Then, in the present embodiment implemented in this manner, the fuel passage 470 is formed to span across a case body 430 and a case cap 431 included in the filter case 43 and a valve housing 477 included in the external residual pressure retention valve 473.

Specifically, as shown in FIGS. 1 and 2, the case body 430 is integrally formed by resin from a closed-bottom portion that forms the housing chamber 463 of the housing portion 46 and a closed-bottom portion that forms the straight portions 470*b*, 470*c* of the protruding portion 47. The case body 430 includes a top portion formed of apertures 432*a*, 432*b*, 342*c* that open in cylindrical hole shapes and a press fitting recess portion 433 opens as a flat-shaped space. The housing aperture 432*a* is formed in a position corresponding to the housing chamber 463. The upstream aperture 432*b* is formed in a position corresponding to the upstream straight portion 470*b*. The downstream aperture 432*c* is formed in a position corresponding to the downstream straight portion 470*c*. The press fitting recess portion 433 is formed to span across the periphery of the upstream aperture 432*b* and the periphery of the downstream aperture 432*c*.

The case cap 431 is integrally formed by resin from a recess portion that forms the communication chamber 462 of the housing portion 46 and a recessed portion that forms the turning back portion 470*a* of the protruding portion 47. The case cap 431 is joined to the case body 430 by fusing, thereby covering all of the apertures 432*a*, 432*b*, 432*c* of the case body 430. As shown in FIG. 2, an upper surface portion 430*a* of the case body 430 and a lower surface portion 431*a* of the case cap 431 are both formed as planes, and are joined to each other on a common imaginary plane Icv. The imaginary plane Icv of the present embodiment is set perpendicular to the axial direction of the filter case 43 along the up and down direction. Accordingly, a joint boundary B is formed on this plane Icv between the case body 430 inside the subtank 20 and the case cap 431 outside the subtank 20.

The valve housing 477 is integrally formed by resin from a cylindrical housing body 477*a* and a flat board shaped joining plate 477*b*. The housing body 477*a* is fitted in the upstream aperture 432*b*. Due to this fitting, a portion of the upstream straight portion 470*b* penetrates into the housing body 477*a* in the up and down direction. The housing body 477*a* includes a valve seat 477*as* that has a diameter which decreases in the down direction. The valve seat 477*as* is formed in a conical shape around the upstream straight portion 470*b*.

The joining plate 477*b* is continuously arranged on the top portion of the housing body 477*a*. The joining plate 477*b* juts out from the housing body 477*a* in a direction perpendicular to the axial direction of the filter case 43. The joining plate 477*b* is press fit into the press fitting recess portion 433 around the apertures 432*b*, 432*c*. As shown in FIG. 2, an upper surface portion 477*bu* and a lower surface portion 477*bl* of the joining plate 477*b* are both formed in a planar shape. Due to this shape, the upper surface portion 477*bu* is joined by fusing to the inner periphery portion of the press fitting recess portion 433 of the upper surface portion 430*a* of the case body 430 and the lower surface portion 431*a* of the case cap 431 on the common imaginary plane Icv. When press fit and fused in this manner, a portion of the upstream straight portion 470*b* and a portion of the downstream straight portion 470*c* penetrate, in the up and down direction, through the joining plate 477*b* which is interposed between the case body 430 and the case cap 431.

In addition to the valve housing 477 configured in this manner, the external residual pressure retention valve 473 further combines a valve element 478 as shown in FIGS. 1 and 2. The valve element 478 is formed in a cylindrical shape from a composite material of resin and rubber or a composite material of metal and rubber. The valve element 478 is coaxially housed within the housing body 477*a*. Due to being housed in this manner, the valve element 478 may seat and separate with respect to the valve seat 477*as* at the penetration location of the upstream straight portion 470*b*. Accordingly, the external residual pressure retention valve 473 opens in response to the valve element 478 separating from the valve seat 477*as*, and closes in response to the valve element 478 seating on the valve seat 477*as*.

Figure 4:
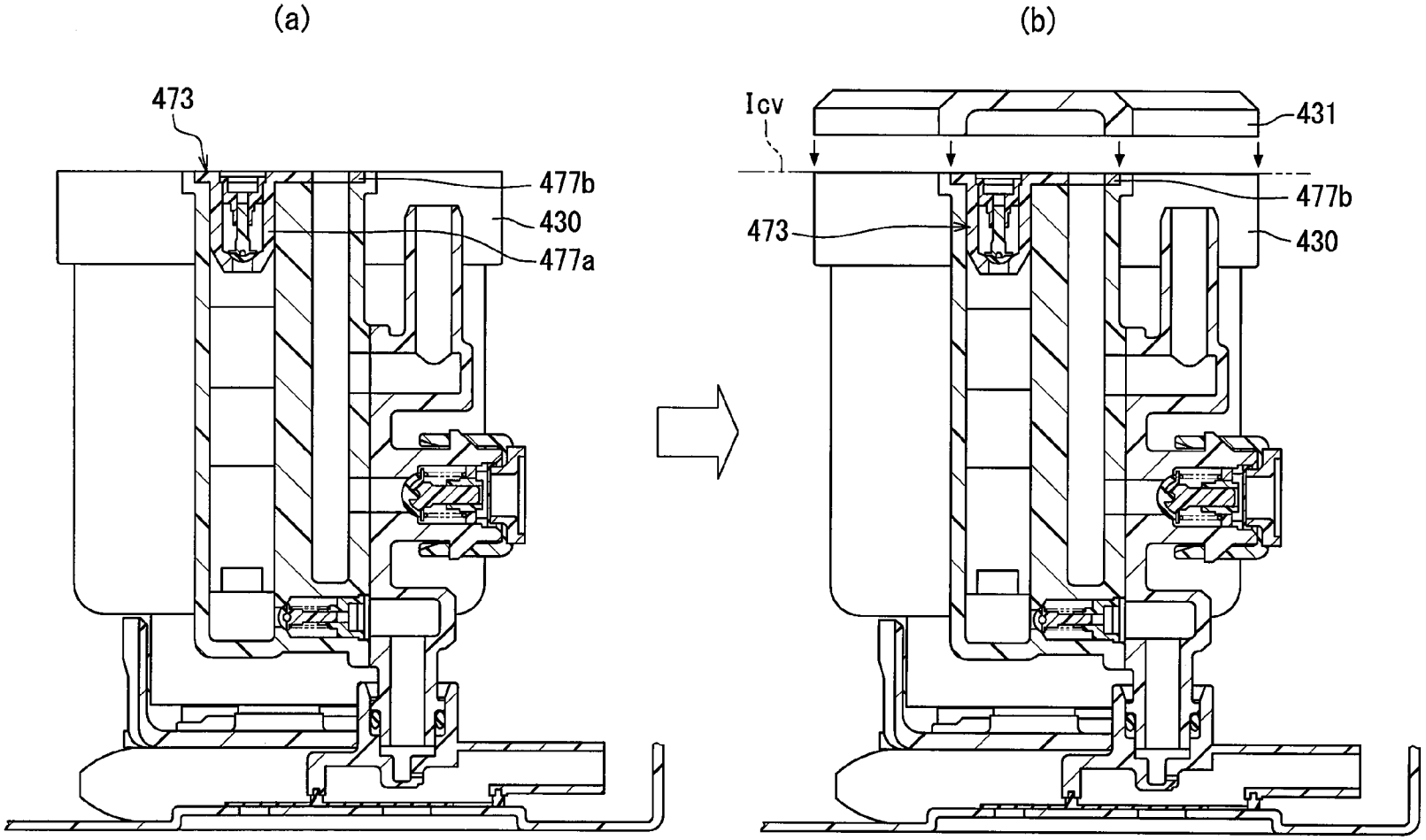
FIG. 4 is a schematic view showing an assembly method of a case cap and an external residual pressure retention valve with a case body in a first embodiment.

According to such a first embodiment, when assembling the case cap 431 and the external residual pressure retention valve 473 to the case body 430, the steps shown in FIG. 4 are performed in order. First, as shown in FIG. 4(*a*), the housing body 477*a* is fitted in the case body 430 and the joining plate 477*b* is press fit with the case body 430. Next, as shown in FIG. 4(*b*), the case cap 431 is overlaid on the common imaginary plane Icv and fused with the case body 430 and the joining plate 477*b*. According, these elements 431, 430, and 477*b* are joined. As a result, the external residual pressure retention valve 473 is, as shown in FIGS. 1 and 2, disposed on the joining boundary B of the case body 430 and the case cap 431 of the filter case 43.

Then, as shown in FIG. 2, the branch passage 474 is formed in a stepped cylindrical hole shape at a bottom end portion of the protruding portion 47, the bottom end portion being positioned lower than the most-downstream end 470*d* and the discharge passage 472. The branch passage 474 branches from the upstream straight portion 470*b* at a location upstream of the external residual pressure retention valve 473. The branch passage 474 branches in a direction perpendicular to the axial direction of the filter case 43. In particular, the branch passage 474 of the first embodiment branches from the upstream straight portion 470*b* toward below the most-downstream end 470*d*, and therefore does not intersect with the downstream straight portion 470*c*. The branch passage 474 is in communication with a jet port 441 of the port member 44. Accordingly, the branch passage 474 guides fuel discharged from the fuel passage 470 through the internal residual pressure retention valve 475 to the jet pump 45.

The internal residual pressure retention valve 475 is disposed in the branch passage 474. In the present embodiment, the internal residual pressure retention valve 475 is a spring-biased type check valve. The internal residual pressure retention valve 475 opens and closes the fuel passage 470 connected to the branch passage 474, and thus acts as one of "a plurality of opening and closing valves". During a period when the fuel pump 42 is operating and consequently fuel having at least a set pressure is discharged from the fuel outlet 463*a*, the internal residual pressure retention valve 475 opens. During this open period, pressurized fuel diverted from the fuel passage 470 into the branch passage 474 flows toward the jet pump 45. Conversely, when the fuel pump 42 is operating but the pressure of the fuel discharged from the fuel outlet 463*a* is less than the set pressure, or when the fuel pump 42 is not operating and consequently this fuel discharge is stopped, the internal residual pressure retention valve 475 closes. During this closed period, the flow of fuel toward the jet pump 45 also stops. Accordingly, especially when the fuel pump 42 is stopped, and also due to the delivery valve 421 being closed, the pressure of the fuel in the housing portion 46 is maintained at the set pressure of the internal residual pressure retention valve 475. In other words, due to the internal residual pressure retention valve 475 being closed, a residual pressure retention function is exerted on the fuel in the housing location of the fuel filter 464. Further, the retention pressure due to the residual pressure retention function of the internal residual pressure retention valve 475 is set to be, e.g., 250 kPa.

The relief passage 476 is formed in a cylindrical hole shape at an intermediate portion of the protruding portion 47 in the up and down direction, located between the passages 472 and 474. The relief passage 476 branches from the downstream straight portion 470*c* at a location downstream from the discharge passage 472. The relief passage 476 branches in a direction perpendicular with respect to the axial direction of the filter case 43. The relief passage 476 is in communication with a relief port 442 of the port member 44. Accordingly, the relief passage 476 guides fuel, which is diverted from a flow toward the internal combustion engine 3 downstream of the external residual pressure retention valve 473 in the filter case 43, to a relief valve 443.

The port member 44 is formed by resin in a hollow shape, and is disposed inside the subtank 20. As shown in FIGS. 2 and 3, the port member 44 joined by fusing with the protruding portion 47 of the specific location S. Both a side surface 44*a* of the port member 44 and a side surface 47*a* of the protruding portion 47 are formed in a planar shape, and are joined to each other on a common imaginary plane Ifp. The imaginary plane Ifp of the present embodiment is parallel to the axial direction of the filter case 43. Accordingly, the port member 44 is joined in a position that juts out from the protruding portion 47 in a direction perpendicular to this axial direction.

Further, the port member 44 of the present embodiment juts out in a direction tangential to the curved outline of an outer circumferential surface 461*a* of the outer cylindrical portion 461, which is curved in a cylindrical surface shape as a "curved surface". In addition, according to the present embodiment, the jutting out amount of the port member 44 is set such that the diameter of a circumscribing circle C in FIG. 3, which contacts the outer circumference of the filter case 43 that includes the outer circumference of the protruding portion 47 which in turn is the outer circumference of the specific location S, and which also contacts the outer circumference of the port member 44, is as small as possible.

As shown in FIGS. 2 and 3, the port member 44 integrally includes the discharge port 440, the jet port 441, the relief port 442, and the relief valve 443 outside of the filter case 43.

The discharge port 440 is formed as an L-shaped space at an upper portion of the port member 44 in the up and down direction. As shown in FIG. 2, the discharge port 440 is in communication with the discharge passage 472 that opens at the side surface 47*a*. In addition, the most-downstream end of the discharge port 440 turns upward at an opposite side from the connection location of the discharge passage 472, thereby communicating with the flexible tube 12*a* (refer to FIG. 1). Due to being in communication in this manner, the discharge port 440 is connected to the fuel passage 470 in the filter case 43 through the discharge passage 472, and is connected toward the internal combustion engine 3 outside the filter case 43 through the flexible tube 12*a* and the fuel supply pipe 12. By connecting the inside and outside of the filter case 43 in this manner, the discharge port 440, which functions as one of "a plurality of fuel ports", discharges fuel, which flowed from the fuel passage 470 to the discharge passage 472, toward the internal combustion engine 3.

The jet port 441 is formed as a reverse L-shaped room at a bottom edge portion of the port member 44, positioned below the discharge port 440. The jet port 441 is in communication with the branch passage 474 that opens at the side surface 47*a*, and at an opposite end from this communication location, is in communication with the jet pump 45. By being in communication in this manner, the jet port 441 is connected to the fuel passage 470 in the filter case 43 through the branch passage 474, and is directly connected to the jet pump 45 outside of the filter case 43. By connecting the inside and outside of the filter case 43 in this manner, the jet port 441, which functions as one of "a plurality of fuel ports", exhibits a function of guiding fuel, which was discharged from the fuel passage 470 through the internal residual pressure retention valve 475, to the jet pump 45.

The relief port 442 is formed in a stepped cylindrical hole shape at a central portion of the port member 44, positioned between the ports 440, 441 in the up and down direction. The relief port 442 is in communication with the relief passage 476 which opens at the side surface 47*a* and, at an opposite side from this communication location, is in communication with the relief valve 443. By being in communication in this manner, the relief port 442 is connected to the fuel passage 470 in the filter case 43 through the relief passage 476, and is directly connected to the relief valve 443 outside of the filter case 43. By connecting the inside and outside of the filter case 43 in this manner, the relief port 442, which functions as one of "a plurality of fuel ports", exhibits a function of guiding fuel, which was diverted from a flow in the fuel passage 470 toward the internal combustion engine 3, to the relief valve 443.

The relief valve 443 is disposed in the relief port 442, and is connected to the fuel passage 470 through the relief passage 476. In addition, the relief valve 443 is in communication with the interior space 26 of the subtank 20 through a most-downstream end 442*a* of the relief port 442. Accordingly, the relief valve 443 is able to discharge fuel guided by the relief passage 476 into this space 26.

According to the present embodiment, the relief valve 443 is a spring-biased type check valve. The relief valve 443 opens and closes the fuel passage 470 connected to the relief port 442. Regardless of whether the fuel pump 42 is operating or stopped, the relief valve 443 is closed as long as a fuel delivery path from the fuel passage 470 to the internal combustion engine 3 remains in a normal state and a pressure of the relief port 442 is under a relief pressure. During this closed period, fuel, which is pressure adjusted by the operation of the fuel pump 42, is discharged through the discharge passage 472 inside the filter case 43 and the discharge port 440 outside the filter case 43, and becomes a supply fuel to the internal combustion engine 3. Meanwhile, regardless of the whether the fuel pump 42 is operating or stopped, the relief valve 443 opens if an abnormality occurs in the fuel supply path from the fuel passage 470 to the internal combustion engine 3 and fuel at or above the relief pressure reaches the relief port 442. During this open period, fuel guided to the relief valve 443 is discharged to the interior space 26 of the subtank 20, and thereby is released until the pressure of the supply fuel to the internal combustion engine 3 becomes the relief pressure. In other words, the relief valve 443, when opened, exerts a relief function on the supply fuel to the internal combustion engine 3. Further, the relief pressure of the relief function of the relief valve 443 is set to be, e.g., 650 kPa.

Next, as shown in FIG. 2, the jet pump 45 is formed by resin as a hollow shape, and is positioned below the port member 44 in the subtank 20. In particular, the jet pump 45 is mounted on the recessed bottom portion 20*b* of the bottom portion 20*a* of the subtank 20. By being mounted in this manner, the jet pump 45 and the port member 44 overlap with the flow inlet 24 on the bottom portion 20*a* in the axial direction of the filter case 43. The jet pump 45 integrally includes a pressurizing portion 450, a nozzle portion 451, a suction portion 452, and a diffuser portion 453.

The pressurizing portion 450 forms a pressurizing passage 454 in a stepped cylindrical hole shape that extends parallel to the axial direction of the filter case 43. The pressurizing passage 454 is positioned below the port member 44 and is connected to the jet port 441. By being connected in this manner, pressurized fuel, which is discharged from the fuel passage 470 in the filter case 43 through the branch passage 474 in the filter case 43, is guided through the jet port 441 outside of the filter case 43 and into the pressurizing passage 454.

The nozzle portion 451 forms a nozzle passage 455 in a cylindrical hole shape that extends in a direction perpendicular to the axial direction of the filter case 43. The nozzle passage 455 is positioned below the pressurizing portion 450, and is connected to the pressurizing passage 454. In addition, the passage cross-sectional area of the nozzle passage 455 narrows down as compared to the pressurizing passage 454. Due to being connected and narrowing down in this manner, the pressurized fuel guided in the pressurizing passage 454 flows into the nozzle passage 455.

The suction portion 452 forms a suction passage 456 as a flat shaped space that extends in a direction perpendicular to the axial direction of the filter case 43. The suction passage 456 is positioned below the pressurizing portion 450 and the nozzle portion 451, and is connected to the flow inlet 24. Due to being connected in this manner, fuel, which flowed into the subtank 20 through the flow inlet 24, flows through the suction passage 456.

The diffuser portion 453 forms a diffuser passage 457 in a cylindrical hole shape that extends in a direction perpendicular to the axial direction of the filter case 43. The diffuser passage 457 is positioned below the pressurizing portion 450 and is connected to the nozzle passage 455. Further, at an opposite side from this connection location, the diffuser passage 457 is connected to the interior space 26 of the subtank 20. In addition, the passage cross-sectional area of the diffuser passage 457 is expanding as compared to the nozzle passage 455. Due to being connected and expanding in this manner, the pressurized fuel flowing into the nozzle passage 455 is ejected out into the diffuser passage 457. Accordingly, when a negative pressure is generated around this ejected stream, the fuel in the fuel tank 2 is sucked from the flow inlet 24 into the suction passage 456 and the diffuser passage 457, in this order. The fuel sucked in this manner is diffused in the diffuser passage 457 and pumped, and is thereby transmitted to the interior space 26 including the vicinity of the fuel pump 42.

Further, the diffuser passage 457 of the present embodiment, which has a large diameter circular cross-section, is above and eccentric with respect to the nozzle passage 455, which has a small diameter circular cross-section. In addition, according to the present embodiment, a most-downstream end 457*a* of the diffuser passage 457 is connected to the interior space 26. The most-downstream end 457*a* is spaced upward from a deepest bottom portion 20*d* of the bottom portion 20*a* of the subtank 20. The deepest bottom portion 20*d* surrounds the periphery of the recessed bottom portion 20*b*.

(Operation Effects)

Next, the operation effects of the first embodiment described above will be explained.

According to the first embodiment, the port member 44, which integrally includes the plurality of ports 440, 441, 442, is joined to the filter case 43. Accordingly, these ports 440, 441, 442 connect between the inside and outside of the filter case 43. In this regard, while prioritizing reserving a housing location for the fuel filter 464 that is suitable for a fuel filtering function, the reserving of the forming location of each port 440, 441, 442 is separated from the filter case 43. As a result, by joining the port member 44, which is specialized in ensuring forming locations for each port 440, 441, 442, to the filter case 43 which has a simplified structure, the device 1 may be manufactured according to specification, and productivity of this device 1 may be improved.

In addition, according to the first embodiment, the filter case 43 and the port member 44 are joined to each other on a common imaginary plane Ifp. Therefore, this joining operation is not only easy, but defective joining is less likely. Accordingly, both the productivity and the yield rate of the device 1 may be improved.

Further, according to the first embodiment, the port member 44 includes the discharge port 440 that discharges fuel inside the filter case 43 to outside of the filter case 43 toward the internal combustion engine 3. Accordingly, the degree of design freedom of the forming location of the discharge port 440 is improved by the port member 44. Further, the structure of this port member 44 and the attached filter case 43 is simplified, and the productivity of the device 1 may be improved.

Further, according to the first embodiment, in order to transfer fuel in the fuel tank 2 to the vicinity of the fuel pump 42, the port member 44 includes the jet port 441 that guides fuel which is discharged from inside the filter case 43 and sprayed out from the jet pump 45. Accordingly, the port member 44 ensures the forming location of the jet port 441 according to the placement point of the jet pump 45. Further, the structure of this port member 44 and the attached filter case 43 is simplified, and the productivity of the device 1 may be improved.

Here, according to typical specifications, fuel discharge toward the internal combustion engine 3 is implemented at the upper region of the fuel tank 2. Meanwhile, fuel transfer to the vicinity of the fuel pump 42 is implemented at the lower region of the fuel tank 2. In this regard, according to the present embodiment, the jet port 441, which guides fuel to the jet pump 45 that transfers fuel, is formed below the discharge port 440, which discharges fuel toward the internal combustion engine 3. Thus, the structure of the port member 44 is conformed to specification and is simplified. Accordingly, by simplifying the structure of the filter case 43 due to including the discharge port 440 and the jet port 441 in the port member 44, it is possible to promote the productivity improvement of the device 1.

Further, according to the first embodiment, the closed bottom subtank 20 stores, in the vicinity of the fuel pump 42, transferred fuel which flowed in from inside the fuel tank 2 through the flow inlet 24 of the bottom portion 20*a* due to the jet pump 45. Accordingly, the remaining fuel in the fuel tank 2 may prevent the vicinity of the fuel pump 42 from running out of fuel. Moreover, the port member 44 which forms the jet port 441, and the jet pump 45 to which the jet port 441 guides fuel, are disposed to overlap with the flow inlet 24 in the axial direction of the filter case 43 on the bottom portion 20*a* of the subtank 20. Accordingly, the productivity of the device 1 may be improved by simplifying (e.g., automating) the placement process of the jet pump 45 and the port member 44 while conforming to the forming location of the flow inlet 24. Further, since the placement area of the jet pump 45 and the port member 44 is reduced, the device 1 may be miniaturized.

Further, according to the first embodiment, the port member 44 forms the relief valve 442. The relief valve 442 guides fuel in the filter case 43, which was diverted from a flow toward the internal combustion engine 3, to the relief valve 443. Accordingly, the port member 44 may ensure the forming location of the relief port 442 according to the placement location of the relief valve 443. Further, the structure of the filter case 43, which is joined to the port member 44, may be simplified, and the productivity of the device 1 may be improved. In addition, due to the relief functionality in which the relief valve 443 guides the diverted fuel to release the pressure of the supply fuel to the internal combustion engine 3, it is possible to avoid an abnormal situation where the pressure of the supply fuel becomes excessively high. As a result, it is possible to ensure the durability of the internal combustion engine 3.

Further, according to the first embodiment, the port member 44, which forms the relief port 442, integrally includes the relief valve 443 with this relief port 442. Accordingly, the port member 44 may ensure the forming location of the relief port 442 as well as the placement location of the relief valve 443. Further, the structure of this port member 44 and the attached filter case 43 is simplified, and the productivity of the device 1 may be improved.

Second Embodiment

Figure 5:
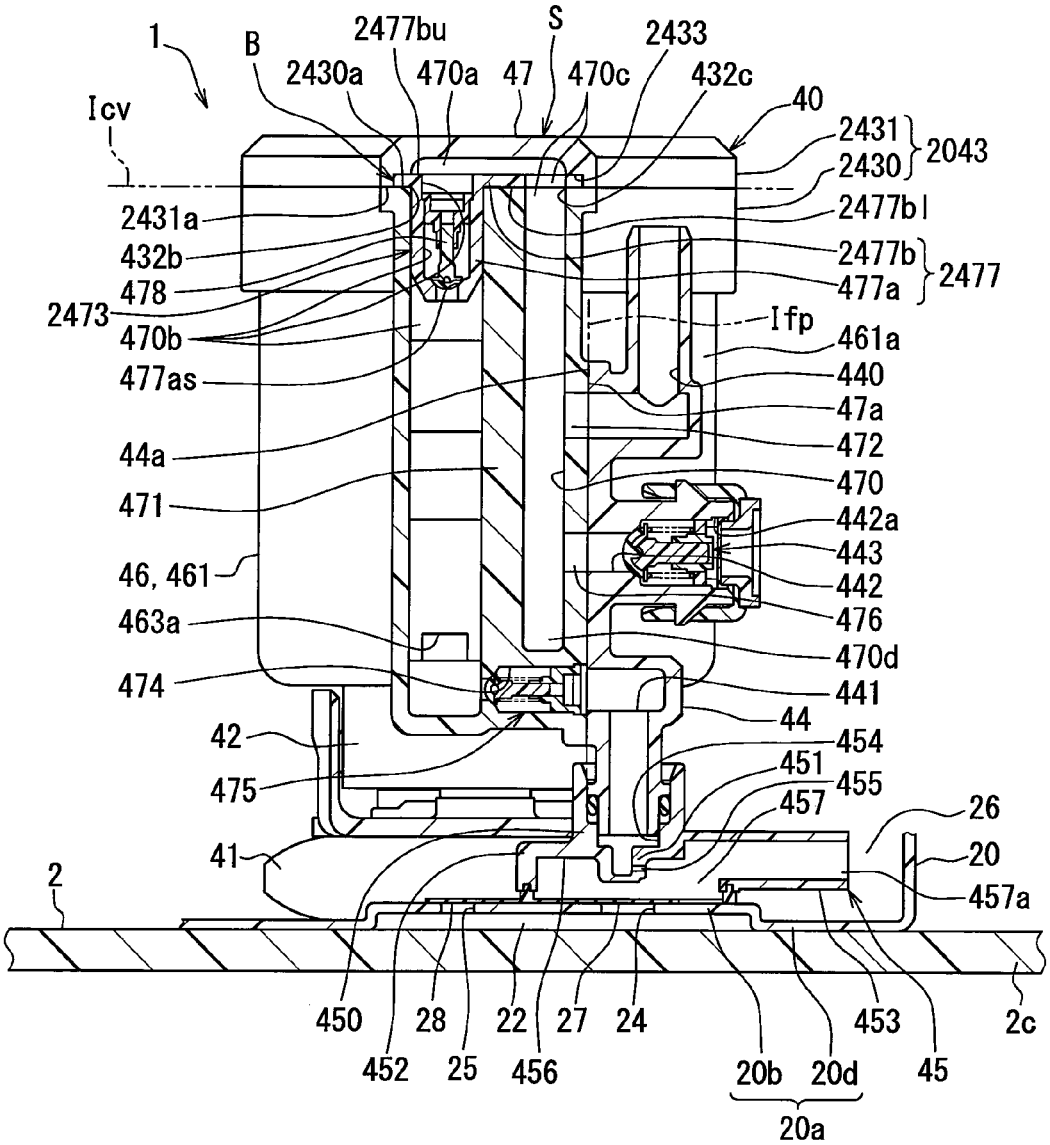
FIG. 5 is a cross-sectional view corresponding to FIG. 2 showing a pump unit of a fuel supply device according to a second embodiment.

As shown in FIG. 5, a second embodiment of the present disclosure is a modified example of the first embodiment. In the second embodiment, a press fitting recess portion 2433 is formed as a flat shaped space at the opening periphery of the turning back portion 470*a* at the bottom portion of a case cap 2431. A joining plate 2477*b* of a valve housing 2477 is press fit into this recess portion 2433. Here, both a lower surface portion 2477*bl* and an upper surface portion 2477*bu* of the joining plate 2477*b* are formed in a planar shape. Due to this shape, the lower surface portion 2477*bl* is joined by fusing, on the common imaginary plane Icv, to the inner rim portion of the press fitting recess portion 2433 in a lower surface portion 2431*a* of the case cap 2431 and to an upper surface portion 2430*a* of a case body 2430. Due to these elements being press fit and joined in this manner, the joining plate 2477*b*, which is interposed between the case body 2430 and the case cap 2431 and which is in the case cap 2431, penetrates a portion of the upstream straight portion 470*b* and a portion of the downstream straight portion 470*c* in the up and down direction.

Figure 6:
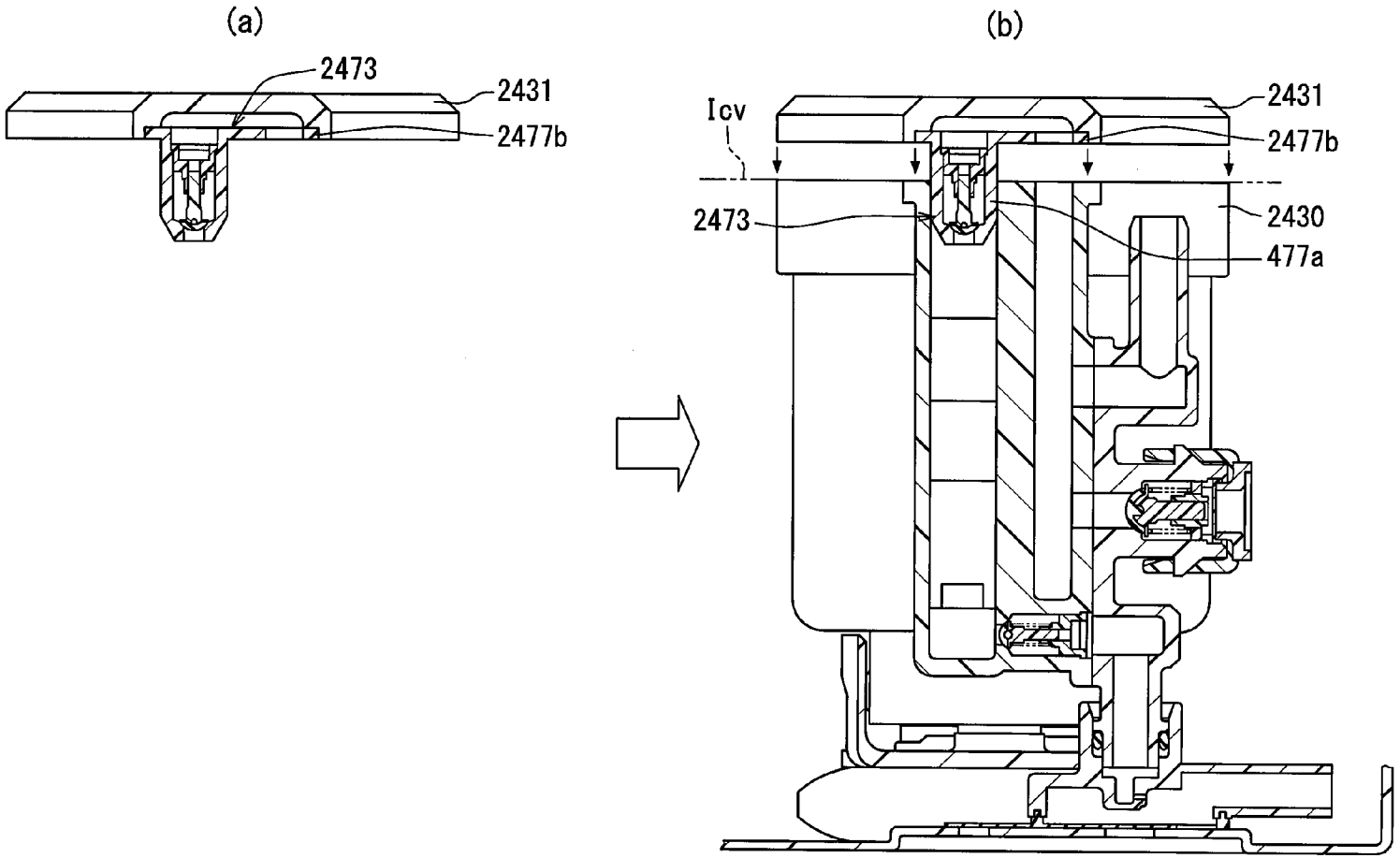
FIG. 6 is a schematic view showing an assembly method of a case cap and an external residual pressure retention valve with a case body in a second embodiment.

According to the second embodiment in this manner, when assembling the case cap 2431 and an external residual pressure retention valve 2473 to the case body 2430, the steps shown in FIG. 6 are performed in order. First, as shown in FIG. 6(*a*), the joining plate 2477*b* is press fit with the case cap 2431. Next, as shown in FIG. 6(*b*), the housing body 477*a* is fit in the case body 2430, then the joining plate 2477*b* the case cap 2431 are overlaid on the common imaginary plane Icv and fused with the case body 2430. According, these elements 2430, 2477*b*, and 2431 are joined. As a result, the external residual pressure retention valve 2473 is, as shown in FIG. 5, disposed on the joining boundary B of the case body 2430 and the case cap 2431 of a filter case 2043.

Thus, according to the second embodiment as well, the same operation effects as the first embodiment may be exhibited.

Third Embodiment

Figure 7:
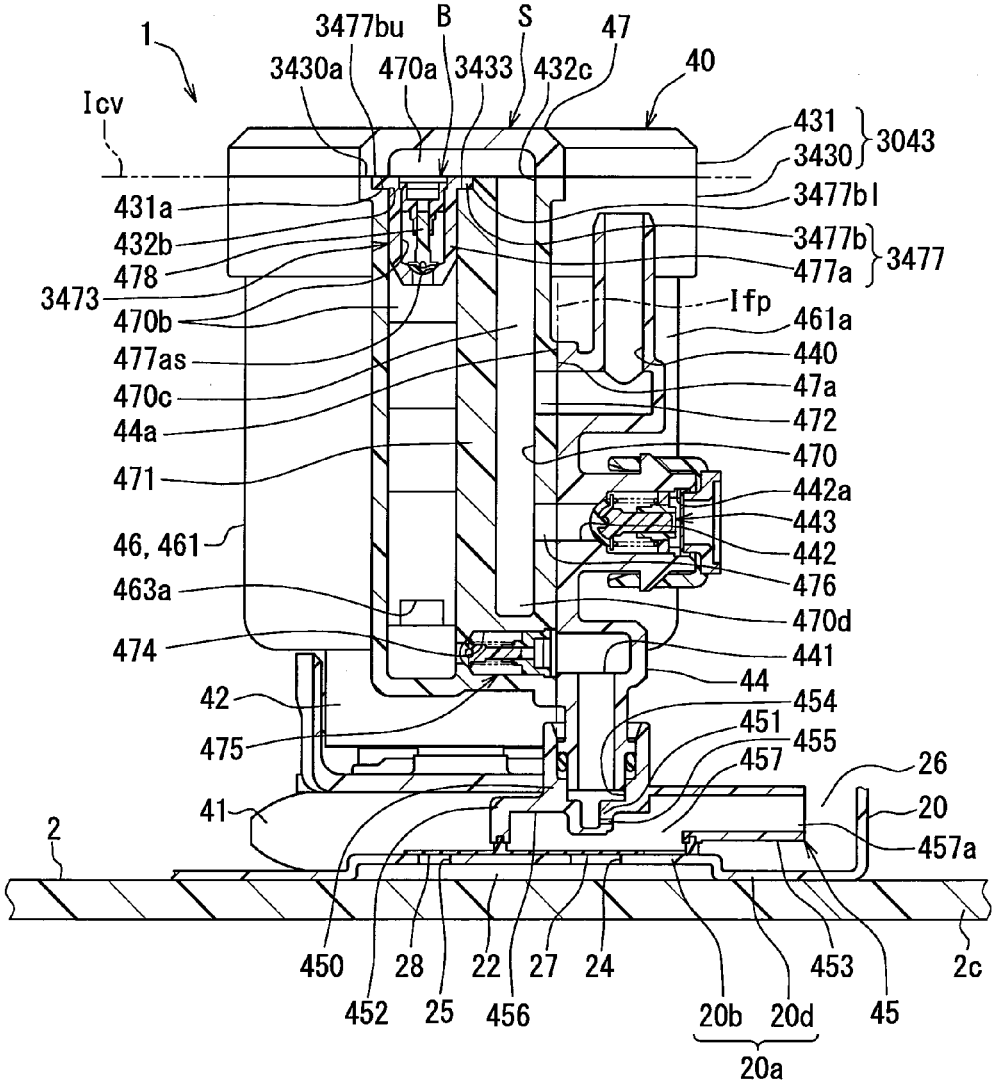
FIG. 7 is a cross-sectional view corresponding to FIG. 2 showing a pump unit of a fuel supply device according to a third embodiment.

As shown in FIG. 7, a third embodiment of the present embodiment is a modified example of the first embodiment. A press fitting recess portion 3433 of the third embodiment is formed as a flat shaped space at only the periphery of the upstream aperture 432*b*, which is a location corresponding to the upstream straight portion 470*b* at the upper region of a case body 3430.

Further, according to a valve housing 3477 of the third embodiment, instead of the joining plate 477*b*, a joining flange 3477*b* is integrally formed together with the housing body 477*a* from resin. The joining flange 3477*b*, which continuously arranged on the upper region of the housing body 477*a*, is formed in an annular flange shape along the outer circumference of this body 477*a*. The joining flange 3477*b* is press fit into the press fitting recess portion 3433. Here, both an upper surface portion 3477*bu* and a lower surface portion 3477*bl* of the joining flange 3477*b* are formed in a planar shape. Due to this shape, the upper surface portion 3477*bu* is joined by fusing, on the common imaginary plane Icv, to the inner rim portion of the press fitting recess portion 3433 in the upper surface portion 3430*a* of the case body 3430 and to the lower surface portion 431*a* of the case cap 431. Due to these elements being press fit and joined in this manner, the joining flange 3477*b*, which is interposed between the case body 3430 and the case cap 431, penetrates a portion of the upstream straight portion 470*b* in the up and down direction.

Figure 8:
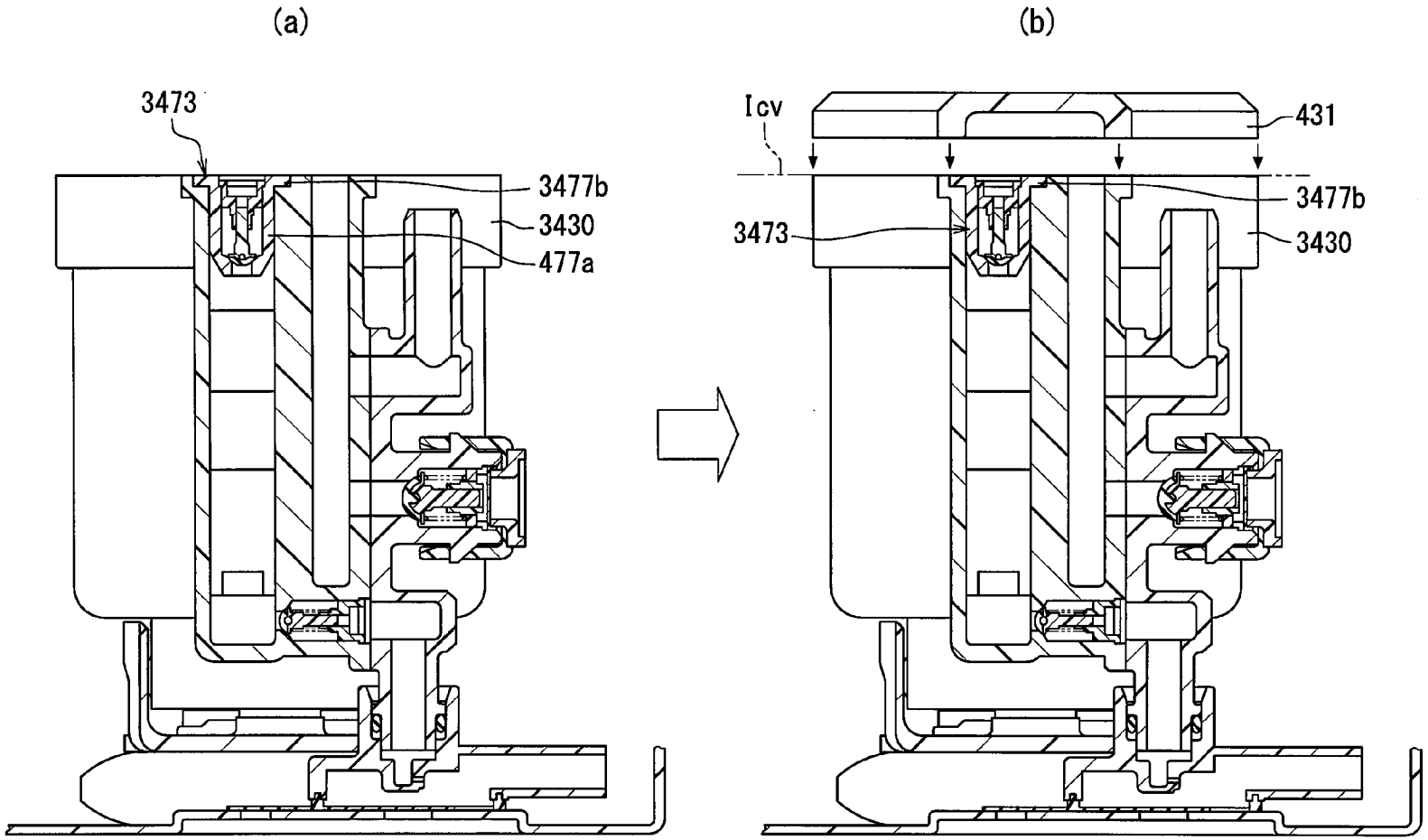
FIG. 8 is a schematic view showing an assembly method of a case cap and an external residual pressure retention valve with a case body in a third embodiment.

According to such a third embodiment, when assembling the case cap 431 and the external residual pressure retention valve 3473 to the case body 3430, the steps shown in FIG. 8 are performed in order. First, as shown in FIG. 8(*a*), the housing body 477*a* is fitted in the case body 3430 and the joining flange 3477*b* is press fit with the case body 3430. Next, as shown in FIG. 8(*b*), the case cap 431 is overlaid on the common imaginary plane Icv and fused with the case body 3430 and the joining flange 3477*b*. According, these elements 431, 3430, and 3477*b* are joined. As a result, the external residual pressure retention valve 3473 is, as shown in FIG. 7, disposed on the joining boundary B of the case body 3430 and the case cap 431 of the filter case 3043.

Thus, according to the third embodiment as well, the same operation effects as the first embodiment may be exhibited.

Fourth Embodiment

Figure 9:
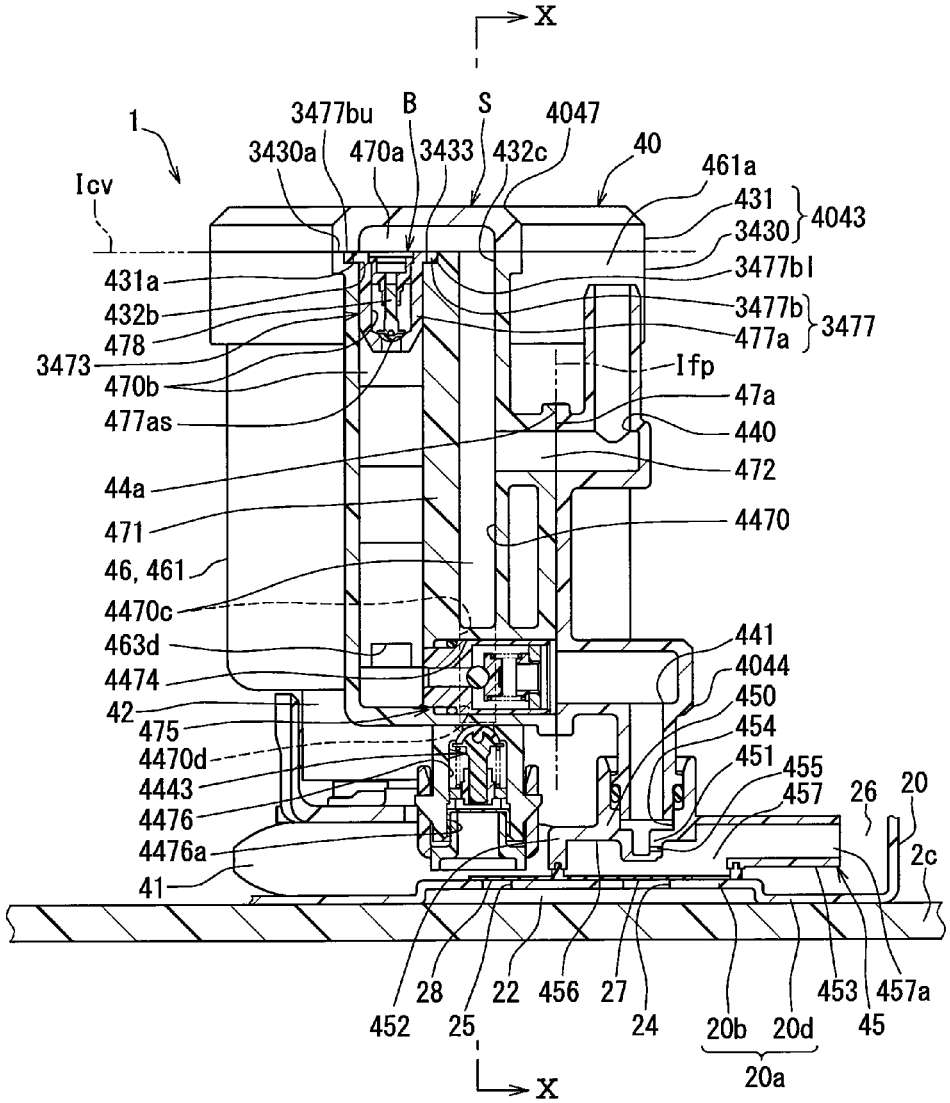
FIG. 9 is a view corresponding to FIG. 2 showing a pump unit of a fuel supply device according to a fourth embodiment, and is a cross-sectional view along IX-IX of FIG. 11.
Figure 10:
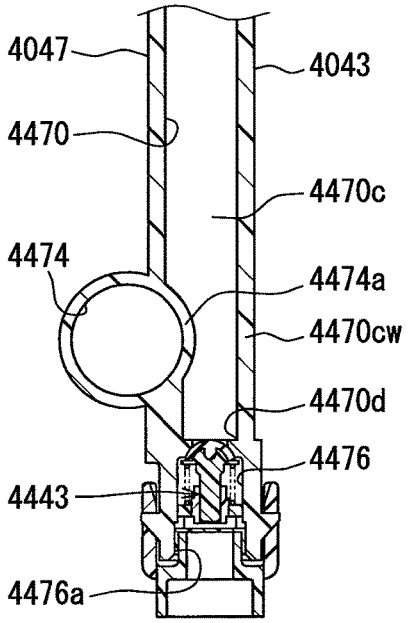
FIG. 10 is a cross-sectional view along X-X of FIG. 9.

As shown in FIGS. 9 and 10, a fourth embodiment of the present embodiment is a modified example of the third embodiment. According to a downstream straight portion 4470*c* of the fourth embodiment, a most-downstream end 4470*d* of a protruding portion 4047 extends until below a branch passage 4474. Due to this extended shape, the branch passage 4474 is disposed to intersect with the downstream straight portion 4470*c*. In particular, according to the present embodiment, the branch passage 4474 is disposed substantially perpendicular to the downstream straight portion 4470*c*. Here, as shown in FIG. 10, a passage wall 4474*a* of the branch passage 4474 ensures a passage cross section area toward the most-downstream end 4470*d* between a passage wall 4470*cw* of the downstream straight portion 4470*c* in the intersection.

Further, as shown in FIGS. 9 and 10, a relief passage 4476 of the fourth embodiment is formed in a stepped cylindrical hole shape at a lower edge portion which extends to below the branch passage 4474 of the protruding portion 4047. The relief passage 4476 further extends in the axial direction of a filter case 4043 from the most-downstream end 4470*d* of a fuel passage 4470.

Figure 11:
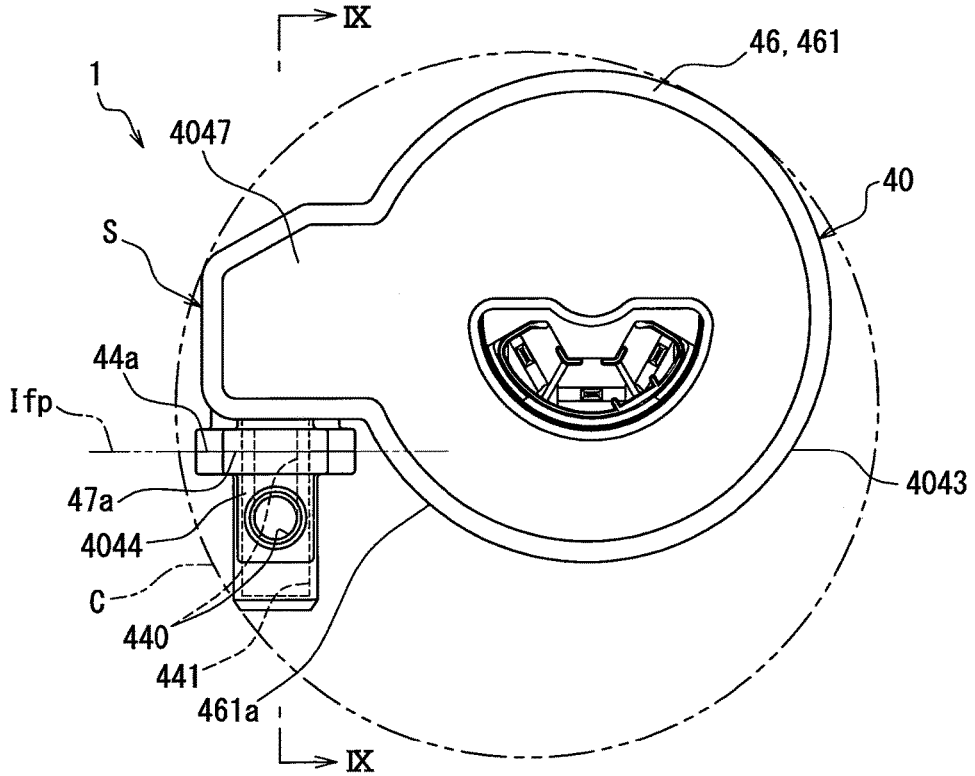
FIG. 11 is a plane view showing a pump unit of FIG. 9.

Further, as shown in FIGS. 9 and 11, a port member 4044 of the fourth embodiment is joined to the protruding portion 4047 of the filter case 4043, and forms the discharge port 440 and the jet port 441. However, the port member 4044 does not form the relief port 442. In this regard, as shown in FIGS. 9 and 10, a relief valve 4443 of the fourth embodiment is disposed in the relief passage 4476 in the filter case 4043 and is in communication with the fuel passage 4470. As such, the relief valve 4443 functions as one of "a plurality of opening and closing valves" for opening and closing this passage 4470. Furthermore, the relief valve 4443 is in communication with the interior space 26 of the subtank 20 through a most-downstream end 4476*a* of the relief passage 4476. Due to being in communication in this manner, the relief valve 4443 guides fuel, which diverted from a flow toward the internal combustion engine 3, from the relief passage 4476 in the filter case 4043, and may eject this guided fuel into the interior space 26. In addition, the operation of the relief valve 4443 is substantially the same as the relief valve 443 explained in the first embodiment.

Thus, according to the fourth embodiment, aside from the operation effects related to the relief valve 443 and the relief port 442, the same operation effects as the first embodiment may be exhibited.

Fifth Embodiment

Figure 12:
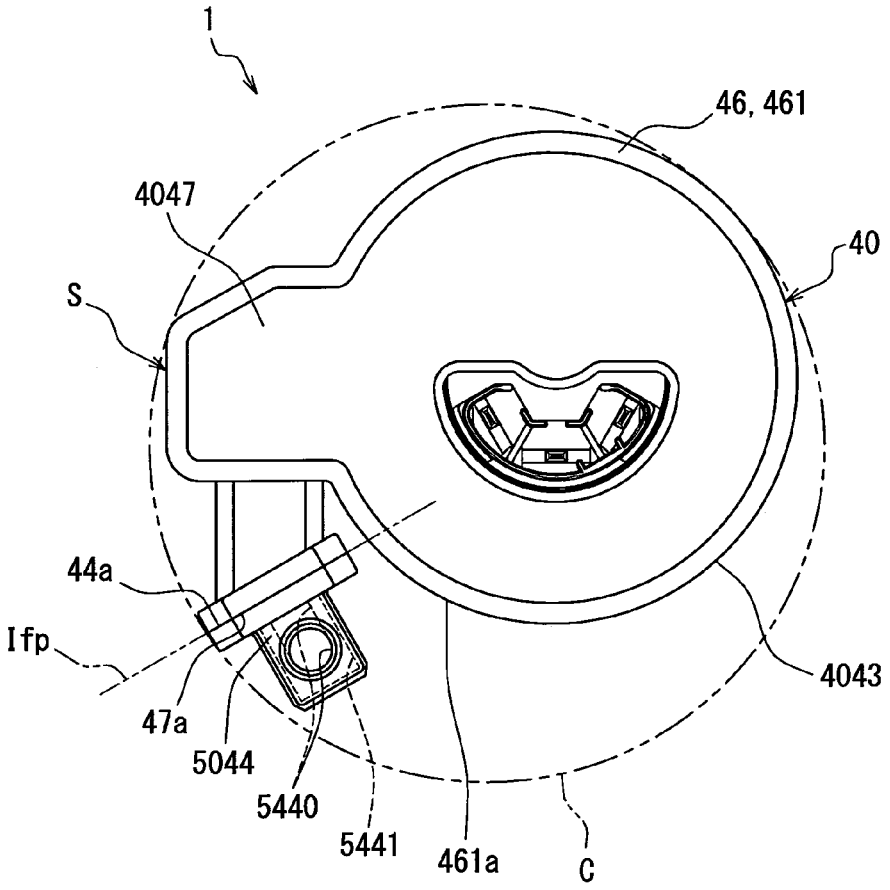
FIG. 12 is a plane view showing a pump unit of a fuel supply device according to a fifth embodiment.

As shown in FIG. 12, a fifth embodiment of the present disclosure is a modified example of the fourth embodiment. A port member 5044 of the fifth embodiment juts out from the protruding portion 4047, and is inclined, from a direction tangential to the curved outline of the cylindrical surfaced outer circumferential surface 461*a* of the housing portion 46 of the filter case 4043, toward this surface 461*a*. By jutting out in this manner, the port member 5044 forms a discharge port 5440 and a jet port 5441 along the outer circumferential surface 461*a*.

In this regard, according to the fifth embodiment, the port member 5044 is joined to filter case 4043. The filter case 4043 has a simple structure including the outer circumferential surface 461*a* which curves in a curved surface shape. Therefore, each port 5440, 5441 is formed along this surface 461*a*. As a result, when viewed along the axial direction, the diameter of a circumscribing circle C that contacts the outer circumference of the filter case 4043 and contacts the outer circumference of the port member 5044 is reduced. Accordingly, the productivity of the device 1, in which the filter case 4043 is miniaturized in the radial direction, may be improved. In addition, aside from this point, the same effects exhibited by the fourth embodiment may also be exhibited by the fifth embodiment.

Sixth Embodiment

Figure 13:
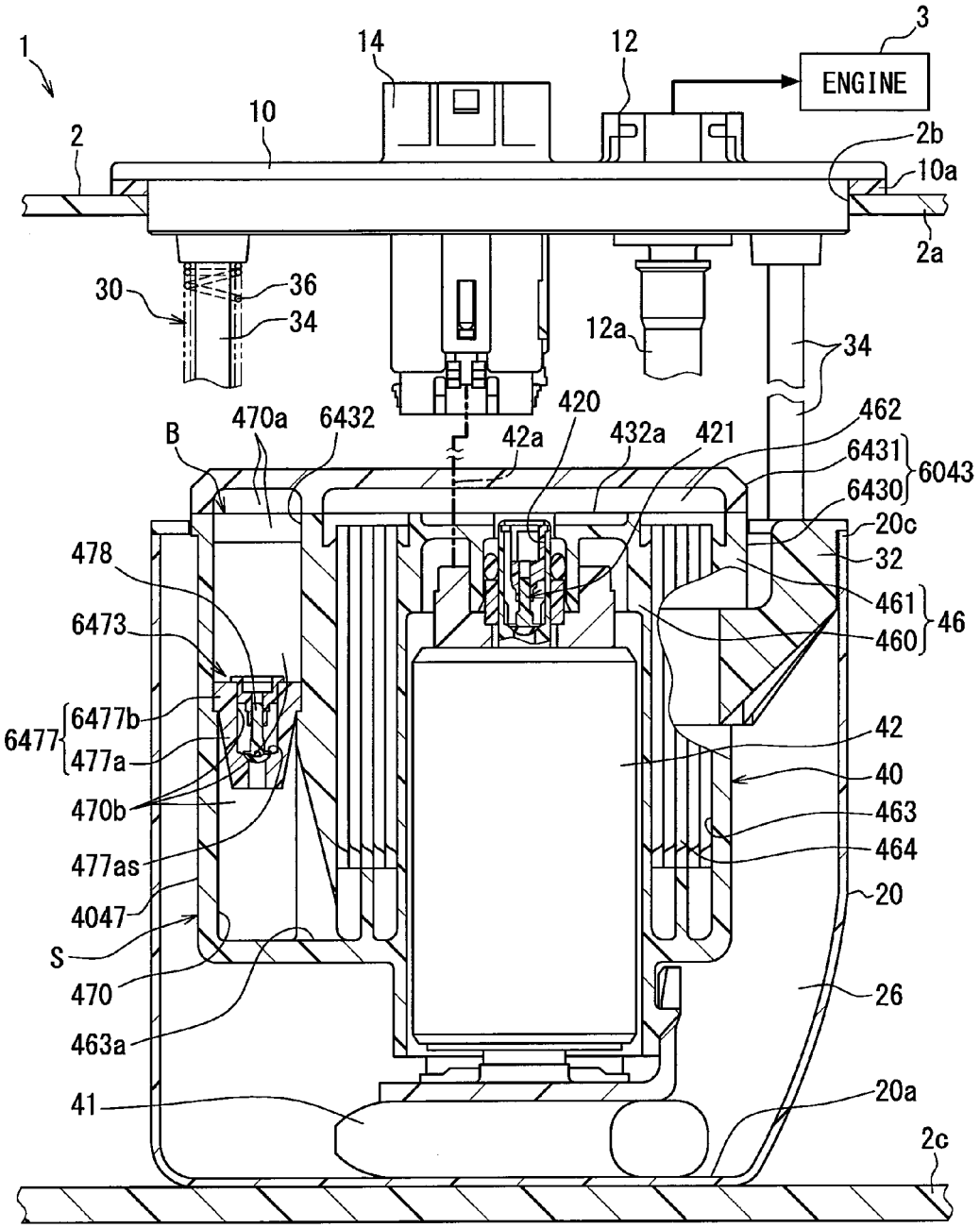
FIG. 13 is a cross-sectional view corresponding to FIG. 1 showing a fuel supply device according to a sixth embodiment.
Figure 14:
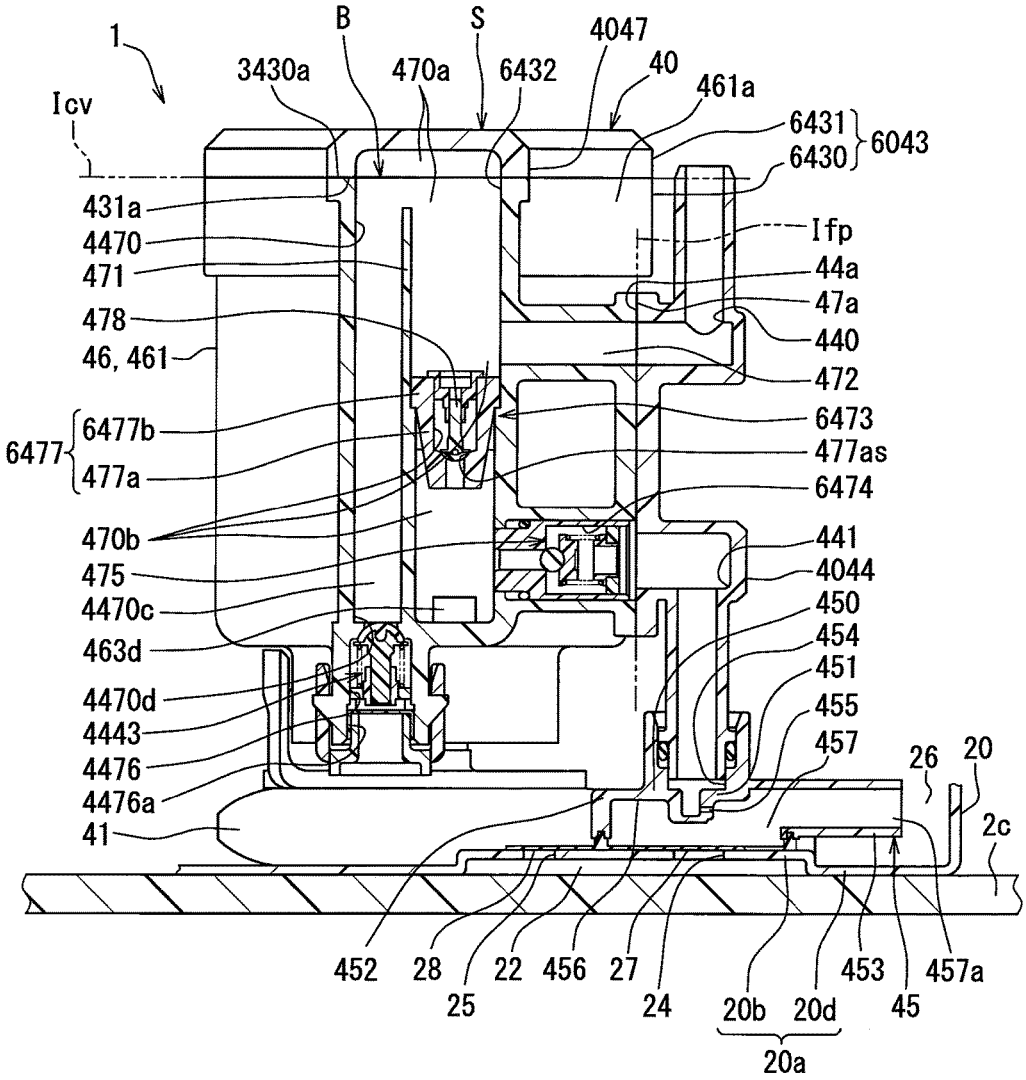
FIG. 14 is a cross-sectional view corresponding to FIG. 2 showing a pump unit of FIG. 13.

As shown in FIGS. 13 and 14, a sixth embodiment of the present disclosure is a modified example of the fourth embodiment. According to a filter case 6043 of the sixth embodiment, a case body 6430 forms a portion of the turning back portion 470*a*, and a case cap 6431 forms the remaining portion of the same portion 470*a*. Here, the joining flange 6477*b* of the valve housing 6477 in the external residual pressure retention valve 6473 of the sixth embodiment is press fit into a middle region of the protruding portion 4047 that forms the upstream straight portion 470*b* below the turning back portion 470*a*.

In addition, the case cap 6431 of the sixth embodiment is joined, by fusing on the imaginary plane Icv, to the case body 6430. Accordingly, the case cap 6431 covers both the housing aperture 432*a* and a fuel aperture 6432. The fuel aperture 6432 forms a portion of the turning back portion 470*a* in the case body 6430. Further, a branch passage 6474 of the sixth embodiment branches from the upstream straight portion 470*b* in an opposite direction from the most-downstream end 4470*d*. Accordingly, the branch passage 6474 does not intersect with the downstream straight portion 4470*c*.

Thus, according to the sixth embodiment as well, the same operation effects as the fourth embodiment may be exhibited.

Seventh Embodiment

Figure 15:
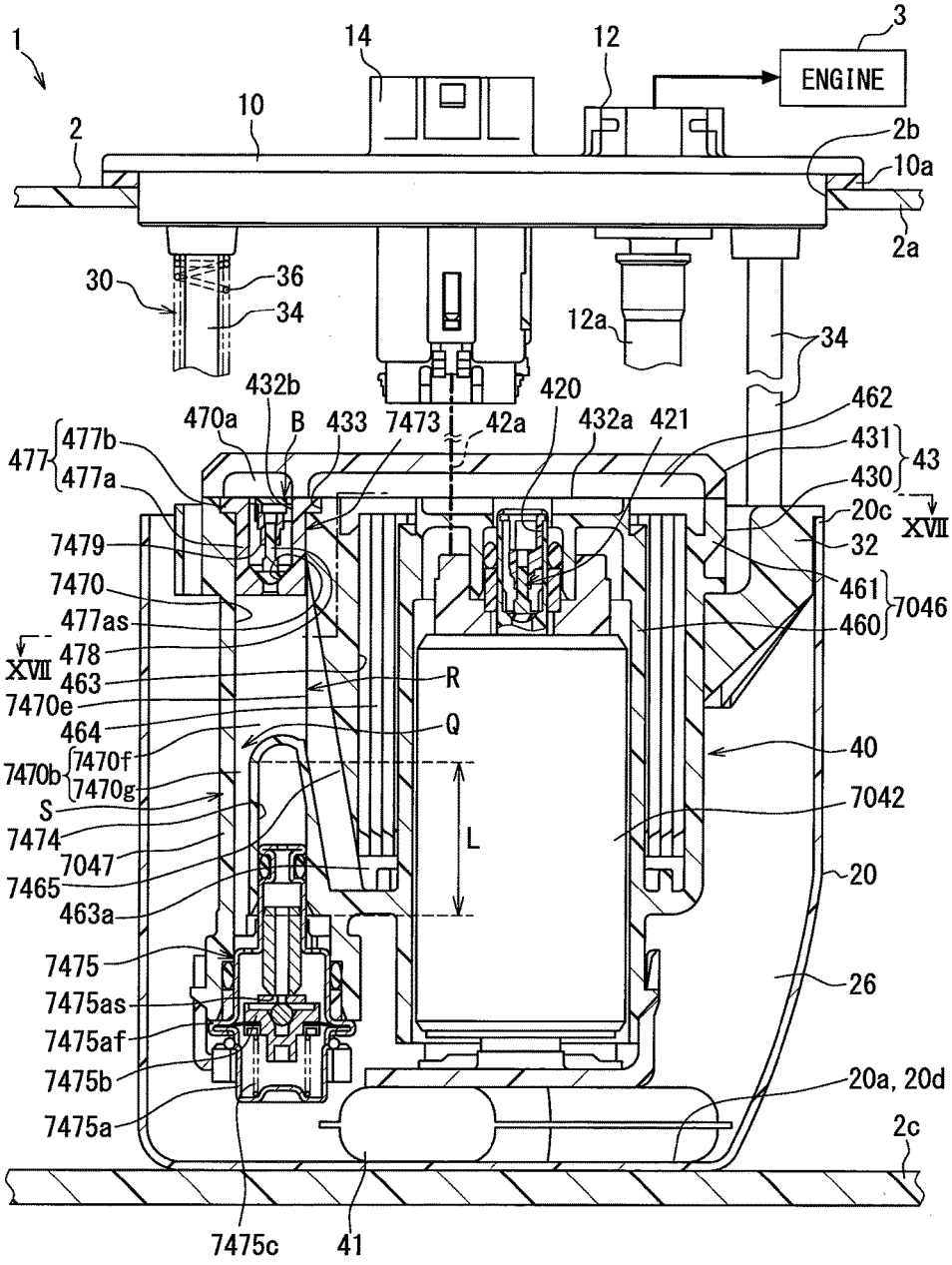
FIG. 15 shows a fuel supply device according to a seventh embodiment, and is a cross-sectional view along XV-XV of FIG. 17.

As shown in FIG. 15, a seventh embodiment of the present disclosure is a modified example of the first embodiment. The pressure of pressurized fuel discharged from a fuel pump 7042 of the seventh embodiment is variably adjusted within a range of, e.g., 300 kPa to 600 kPa.

A housing portion 7046 of the seventh embodiment forms a relay passage 7465 which is in communication with the housing chamber 463. Specifically, the relay passage 7465 is formed as a substantially rectangular shaped hole that is inclined with respect to the axial direction of the filter case 43 along the up and down direction. The relay passage 7465 is in communication with fuel outlet 463*a* which is open below the fuel filter 464 in the housing chamber 463. The relay passage 7465 is inclined in a straight line diagonally upward while spacing away from the fuel outlet 463*a* in the radial direction. Due to this inclined shape, the relay passage 7465 guides fuel, which was filtered by the fuel filter 464 and discharged from the fuel outlet 463*a*, in a diagonally upward direction.

Figure 16:
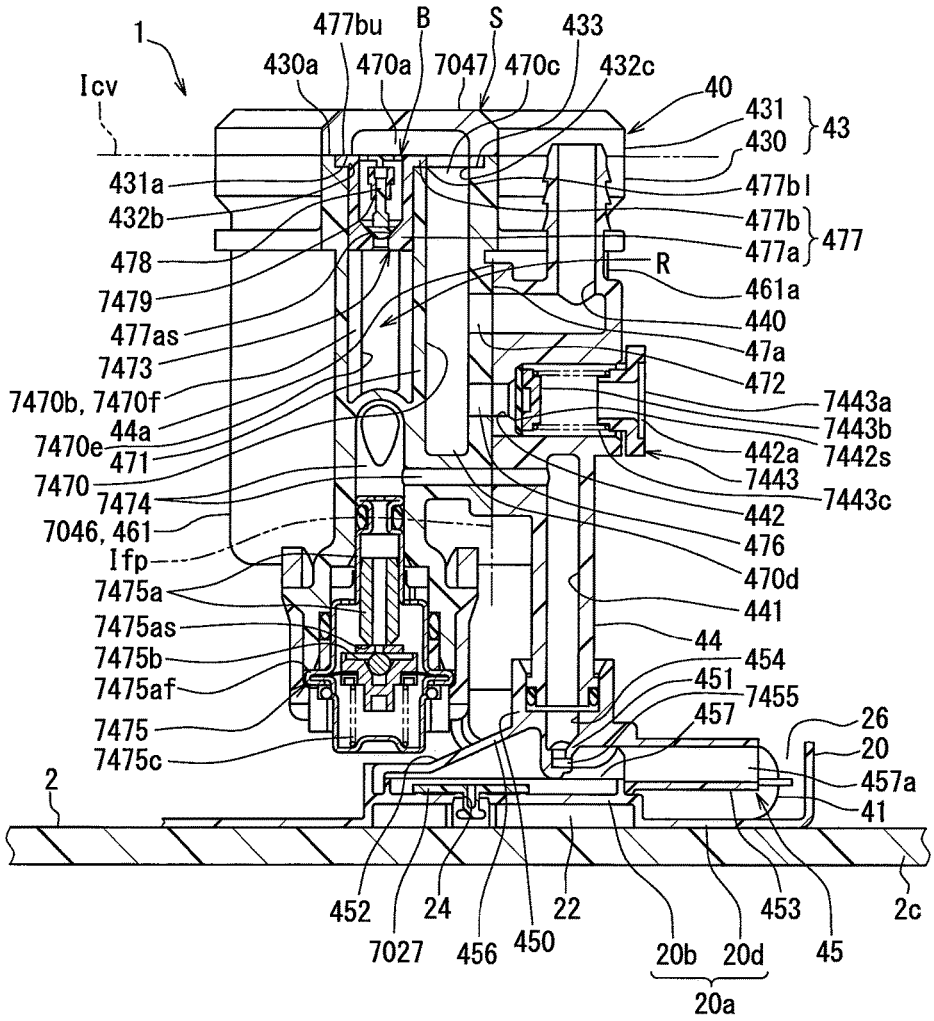
FIG. 16 shows a pump unit of FIG. 15, and is a cross-sectional view along XVI-XVI of FIG. 17.
Figure 17:
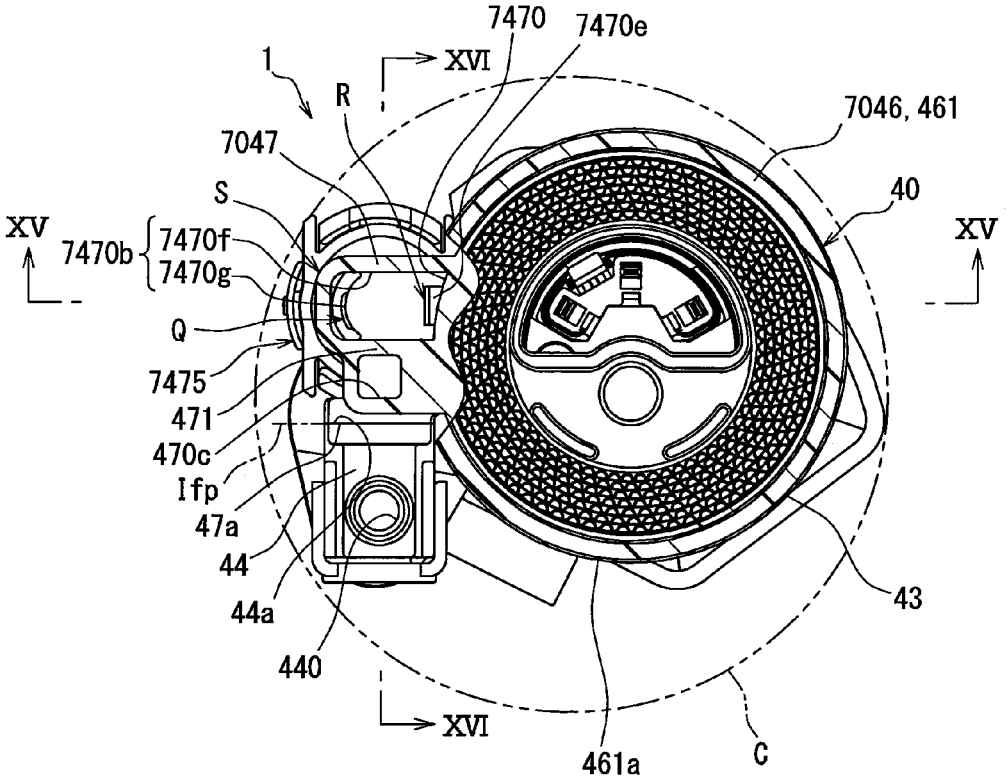
FIG. 17 is a cross-sectional view along XVII-XVII of FIG. 15.

A fuel passage 7470 of the seventh embodiment as shown in FIGS. 15 to 17 forms a communication port 7470*e* that opens at a middle region of an upstream straight portion 7470*b* in the up and down direction. By connecting the communication port 7470*e* to the housing chamber 463 through the relay passage 7465, the upstream straight portion 7470*b* is positioned downstream from the fuel filter 464. Due to this placement, the pressurized fuel guided through the relay passage 7465 is discharged from the communication port 7470*e* into the upstream straight portion 7470*b*. The upstream straight portion 7470*b* forms an external passage portion 7470*f* and an internal passage portion 7470*g*. The external passage portion 7470*f* opens at the communication port 7470*e*. The internal passage portion 7470*g* is connected to the communication port 7470*e* through the external passage portion 7470*f*. The external passage portion 7470*f* and the internal passage portion 7470*g* are included in the protruding portion 7047 along with the elements 471, 472, 7473, 7474, 7475, and 476 of the specific location S.

The external passage portion 7470*f* allows fuel, which is output from the communication port 7470*e*, to flow toward an external residual pressure retention valve 7473 which is above the communication port 7470*e*. Due to this flow, the flow direction of fuel in the relay passage 7465 is, as shown in FIG. 15, inclined with respect to the flow direction of fuel in the external passage portion 7470*f*. The passage cross-sectional area of the external passage portion 7470*f* is enlarged when compared to the passage cross-sectional area of the relay passage 7465 which relays between the communication port 7470*e* and the housing chamber 463. Such an enlarged shape external passage portion 7470*f* guides the pressurized fuel from the communication port 7470*e* toward the downstream straight portion 470*c* for the discharge passage 472 to discharge the pressurized fuel.

The fuel guided by the relay passage 7465 and discharged from the communication port 7470*e* flows through the external passage portion 7470*f* and is turned back toward an internal residual pressure retention valve 7475 at the lower region, and thereby flows toward the internal passage portion 7470*g*. By implementing such a flow pattern, the flow direction of the fuel in the relay passage 7465 is also slanted with respect to the flow direction of the fuel in the internal passage portion 7470*g*. The passage cross-sectional area of the internal passage portion 7470*g* is reduced compared to the passage cross-sectional area of the relay passage 7465 and the passage cross-sectional area of the external passage portion 7470*f*. Due to this reduced shape, the fuel flow in the internal passage portion 7470*g* toward the internal residual pressure retention valve 7475 is narrowed down as compared to that of the external passage portion 7470*f*.

Figure 19:
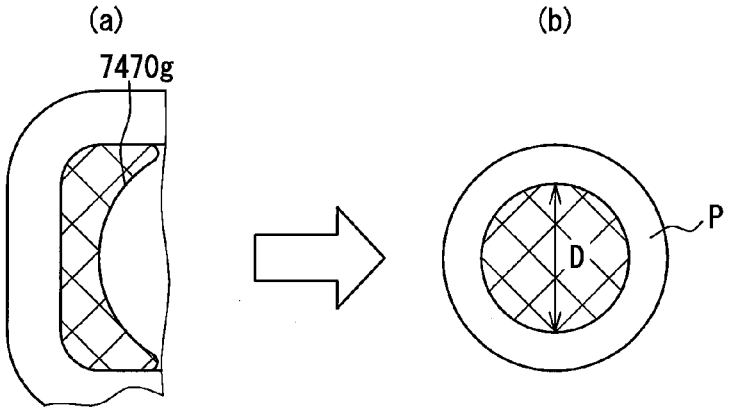
FIG. 19 is a schematic view for explaining characteristics of a fuel supply device according to a seventh embodiment.

Here, the minimum passage cross-sectional area of the internal passage portion 7470*g*, which is indicated by the cross-hatching in FIG. 19(*a*), is virtually converted to the passage cross-sectional area of a cylindrical pipe P, which is indicated by the cross-hatching in FIG. 19(*b*). As a result, the passage diameter D of the cylindrical pipe P, which is obtained from the converted passage cross-sectional area, and a length L of the internal passage portion 7470*g* shown in FIG. 15, which is a distance from the external passage portion 7470*f* to the internal residual pressure retention valve 7475, are set to satisfy the equation $L/D \geq 3$. In addition, the reason for setting the passage diameter D and the length L to satisfy the equation $L/D \geq 3$ will be explained later.

Further, the internal residual pressure retention valve 7475 positioned downstream of the internal passage portion 7470*g* is, as shown in FIGS. 15 to 17, positioned below and spaced away from the external residual pressure retention valve 7473. Disposed in such a manner, in the external passage portion 7470*f*, the communication port 7470*e* opens at a location R, which is a position offset from the internal residual pressure retention valve 7475 toward the external residual pressure retention valve 7473, and the internal passage portion 7470*g* opens below this positional offset location R. Further, as shown in FIGS. 15 and 17, the opening of the internal passage portion 7470*g* is disposed at a spaced location Q in the external passage portion 7470*f*. The spaced location Q is spaced outward in the radial direction from the relay passage 7465 to interpose the internal residual pressure retention valve 7475. In addition, regarding the fuel passage 7470, aside from the above explanations, the configuration of the fuel passage 7470 conforms to the configuration of the fuel passage 470 described in the first embodiment.

In the seventh embodiment shown in FIGS. 15 and 16 as well, the external residual pressure retention valve 7473, which is a spring-less type check valve that acts as one of "a plurality of opening and closing valves", is disposed in the external passage portion 7470*f* which is downstream from the communication port 7470*e* and upstream from the discharge passage 472 in the upstream straight portion 470*b*. In other words, the external residual pressure retention valve 7473 is disposed at a midway region of the fuel passage 7470 from the communication port 7470*e* to the discharge passage 7472. The external residual pressure retention valve 7473 includes the valve housing 477 and the valve element 478 as explained in the first embodiment, and includes a valve stopper 7479. The valve stopper 7479 is formed by resin in a cylindrical shape, and is coaxially fixed in the housing body 477*a*. The valve stopper 7479 reciprocably supports the valve element 478. The valve stopper 7479 locks the valve element 478 when the valve element 478 separates from the valve seat 477*as* and opens.

Due to being configured in this manner, the external residual pressure retention valve 7473 opens and closes the fuel passage 7470. Specifically, while the fuel pump 7042 is operating and pressurized fuel is discharged from the communication port 7470*e* to the external passage portion 7470*f*, the valve element 478 of the external residual pressure retention valve 7473 opens. During this open period, the valve element 478 is locked by the valve stopper 7479, while the pressurized fuel discharged into the external passage portion 7470*f* flows toward the discharge passage 472 and the most-downstream end 470*d* of the downstream straight portion 470*c*. Conversely, when the fuel pump 7042 is stopped and fuel discharge from the communication port 7470*e* is stopped, the valve element 478 closes. During this closed period, the flow of fuel toward the discharge passage 472 and the most-downstream end 470*d* also stops. Accordingly, the pressure of the fuel supplied from the discharge passage 472 to the internal combustion engine 3 before the valve closed is retained. In other words, due to the closed external residual pressure retention valve 7473, a residual pressure retention function is exerted on the supply fuel through the fuel passage 7470 toward the internal combustion engine 3. Here, the retention pressure of the residual pressure retention function of the external residual pressure retention valve 7473 is a pressure which is regulated when the fuel pump 7042 is stopped. Further, regarding the external residual pressure retention valve 7473, aside from the above explanations, the configuration of the external residual pressure retention valve 7473 conforms to the configuration of the external residual pressure retention valve 473 described in the first embodiment.

A branch passage 7474 of the seventh embodiment is formed as a space that extends toward the port member 44 from a location in the protruding portion 7047 interposed between the relay passage 7465 and the internal passage portion 7470*g*, which is at the spaced location Q radially outward from the relay passage 7465. The branch passage 7474 branches upward in a folding back manner from a lower end in the internal passage portion 7470*g* at an opposite side from the external passage portion 7470*f*. Branching in such a manner, the branch passage 7474 does not intersect with the downstream straight portion 470*c*. The branch passage 7474 is in communication with the jet port 441 which opens at the side surface 47*a* of the protruding portion 7047. As a result, fuel discharged from the internal passage portion 7470*g* through the internal residual pressure retention valve 7475 is guided to the jet pump 45.

According to the seventh embodiment shown in FIG. 16, the fuel guided in this manner flows into a nozzle passage 7455 having a passage cross-sectional area that is more narrow than the upstream internal passage portion 7470*g* and pressurizing passage 454. As a result, the flow quantity of the fuel is throttled, and the fuel is sprayed out into the diffuser passage 457. In addition, in the seventh embodiment, the diffuser passage 457 which has a large diameter circular cross-section is centered with the nozzle passage 7455 which has a small diameter circular cross-section. Further, according to the seventh embodiment, in which the flow inlet 25 and the reed valves 27, 28 explained in the first embodiment are not provided, an umbrella valve 7027 that opens the flow inlet 24 when a negative pressure is applied from the jet pump 45 is provided.

In the seventh embodiment shown in FIGS. 15 and 16 as well, the internal residual pressure retention valve 7475, which is a spring-biased type check valve that acts as another one of "a plurality of opening and closing valves", is disposed in the branch passage 7474. The internal residual pressure retention valve 7475 includes a valve housing 7475*a*, a valve element 7475*b*, and a valve spring 7475*c*.

The valve housing 7475*a* is formed by a metal composite material in a stepped cylindrical shape, and is fitted in the protruding portion 7047. A portion of the branch passage 7474 penetrates into the valve housing 7475*a*. The valve housing 7475*a* forms a planar shaped valve seat 7475*as* in the branch passage 7474. According to the valve housing 7475*a*, an annular plate shaped plunger portion 7475*af* is disposed below the relay passage 7465 and below the internal passage portion 7470*g* in an overlapping manner. Accordingly, the internal residual pressure retention valve 7475 may be positioned by the protruding portion 7047, and the device 1 may be miniaturized.

The valve element 7475*b* is formed by a metal composite material in a cylindrical shape, and is coaxially housed within the valve housing 7475*a*. Due to being housed in this manner, the valve element 7475*b* is able separate from and seat on the valve seat 7475*as* by reciprocating. As a result, the internal residual pressure retention valve 7475 opens according to the valve element 7475*b* separating from the valve seat 7475*as*, and closes according to the valve element 7475*b* seating on the valve seat 7475*as*.

The valve spring 7475*c* is formed by metal in a coil shape, and is coaxially locked within the valve housing 7475*a*. The valve spring 7475*c* biases the valve element 7475*b* with a spring reaction force toward the valve seat 7475*as*.

Due to being configured in this manner, the internal residual pressure retention valve 7475 opens and closes the fuel passage 7470 which is in communication with the branch passage 7474. Specifically, when the fuel pump 7042 is operating and fuel is being discharged from the communication port 7470*e* to the passage portions 7470*f*, 7470*g* at or above a set pressure, the valve element 7475*b* of the internal residual pressure retention valve 7475 resists the spring reaction force of the valve spring 7475*c* and opens. During this open period, the valve element 7475*b* is being elastically supported by the valve spring 7475*c*, while pressurized fuel flowing from the internal passage portion 7470*g* into the branch passage 7474 flows toward the jet pump 45. Conversely, even if the fuel pump 7042 is operating, if the pressure of the fuel discharged from the communication port 7470*e* is below the set pressure, or if the fuel pump 7042 is stopped and this discharge is stopped, then the valve element 7475*b* is closed by the spring reaction force. During this closed period, the flow of fuel toward the jet pump 45 also stops. Accordingly, especially when the fuel pump 7042 is stopped, along with the delivery valve 421 being closed, the pressure of the fuel in the housing chamber 463 is retained at the set pressure of the internal residual pressure retention valve 7475. In other words, due to the closed internal residual pressure retention valve 7475, a residual pressure retention function is exerted on the fuel stored in the housing chamber 463. Further, the retention pressure due to the residual pressure retention function of the internal residual pressure retention valve 7475 is set to be, e.g., 250 kPa.

Figure 20:
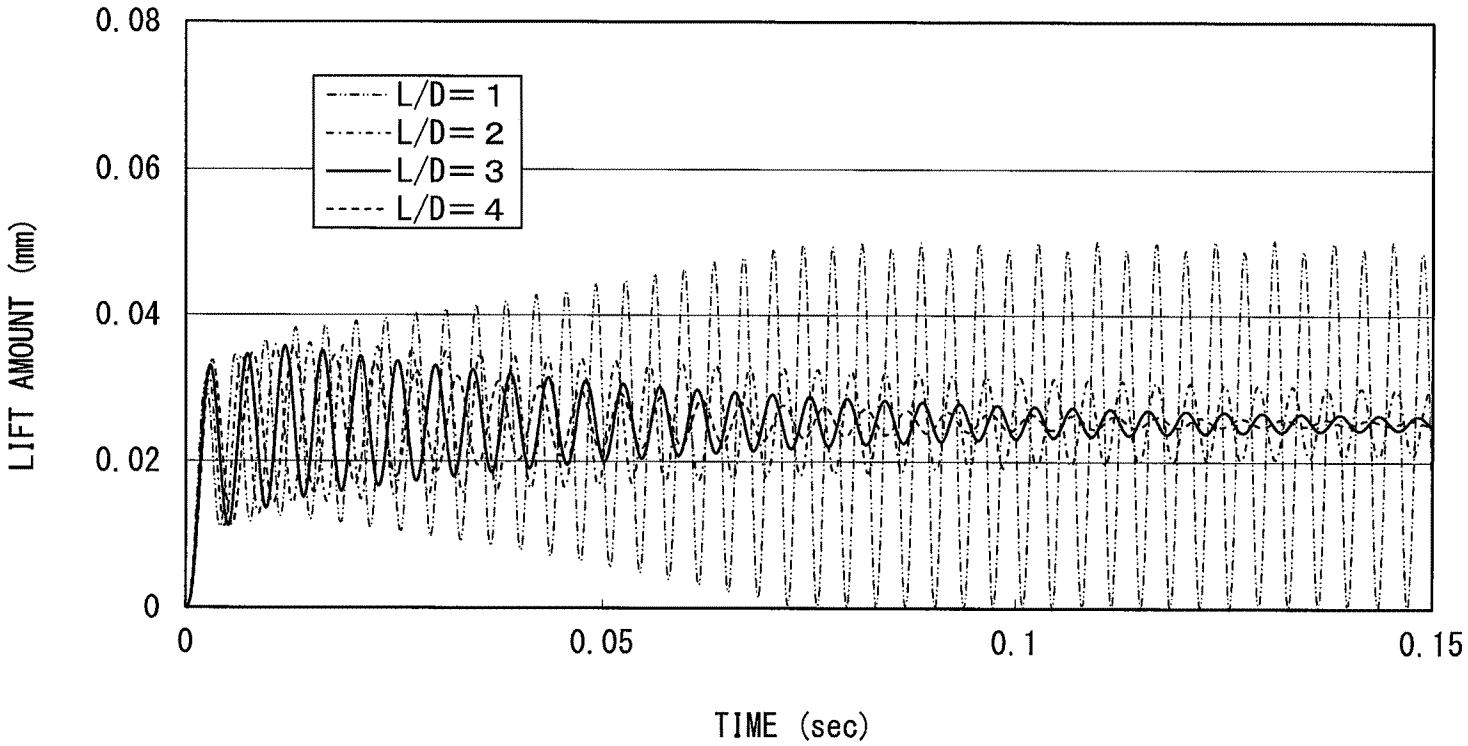
FIG. 20 is a characteristics figure for explaining operation effects of a fuel supply device according to a seventh embodiment.
Figure 21:
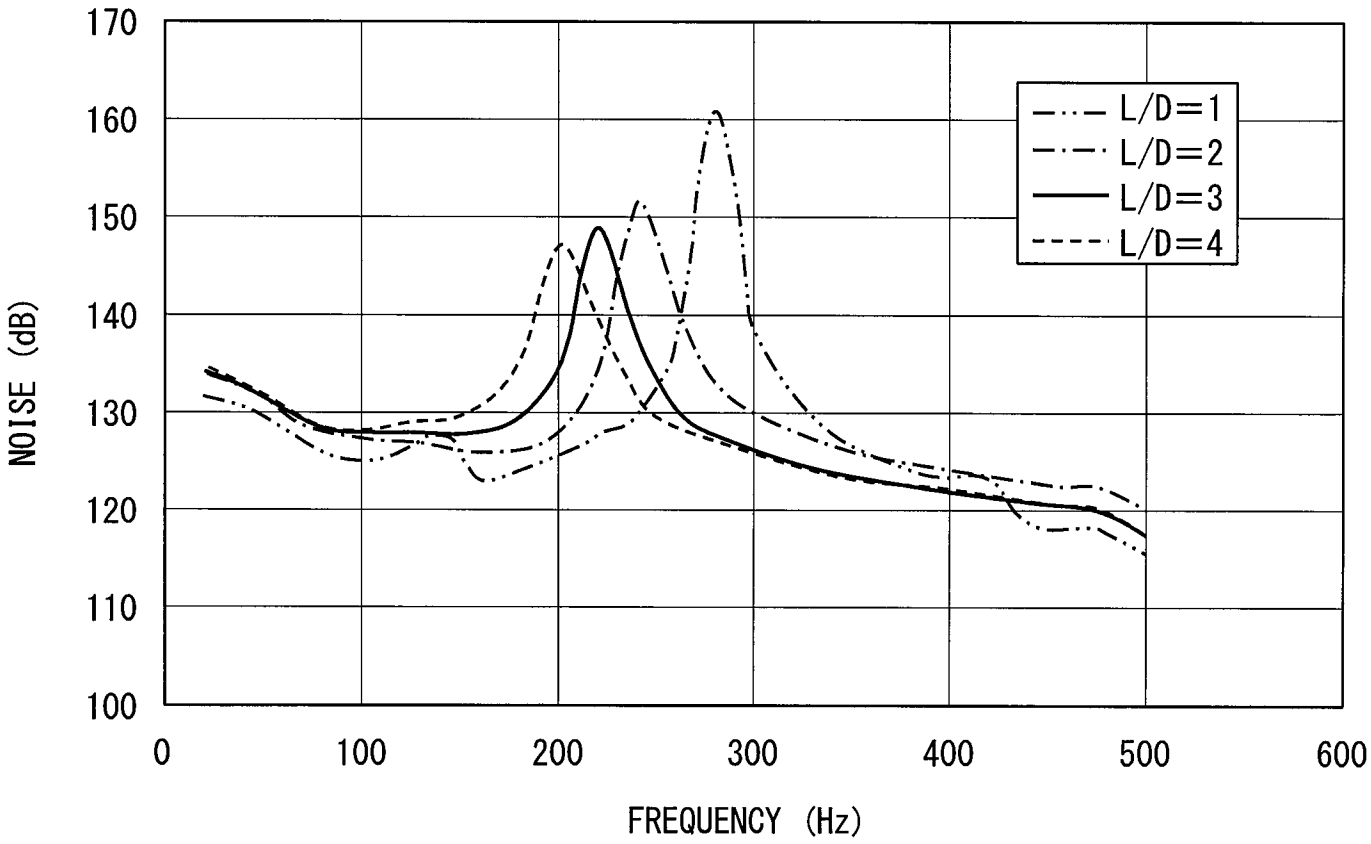
FIG. 21 is a characteristics figure for explaining operation effects of a fuel supply device according to a seventh embodiment.

According to the internal residual pressure retention valve 7475, which is configured as a spring-mass system in this manner, when the lift amount (separation amount) of the valve element 7475*b* from the valve seat 7475*as* is small or the like, there is a concern that the valve element 7475*b* may vibrate in response to pressure oscillation generated by the fuel pump 7042 pumping fuel. However, according to the seventh embodiment as described above, the passage diameter D of the cylindrical pipe P converted from the passage cross-sectional area of the internal passage portion 7470*g* and the length L of the same passage portion 7470*g* are set to satisfy the equation $L/D \geq 3$. Due to being set in this manner, the vibration of the valve element 7475*b* due to pressure oscillations is, as shown in FIG. 20, attenuated over time until reaching a substantially zero level. Therefore, as shown in FIG. 21, the noise generated in the path from the fuel passage 7470 to the internal combustion engine 3 is reduced. In addition, in FIGS. 20 and 21, the cases of $L/D=3$ and $L/D=4$ are shown as the seventh embodiment, while the cases of $L/D=1$ and $L/D=2$ are shown are comparative examples.

Figure 18:
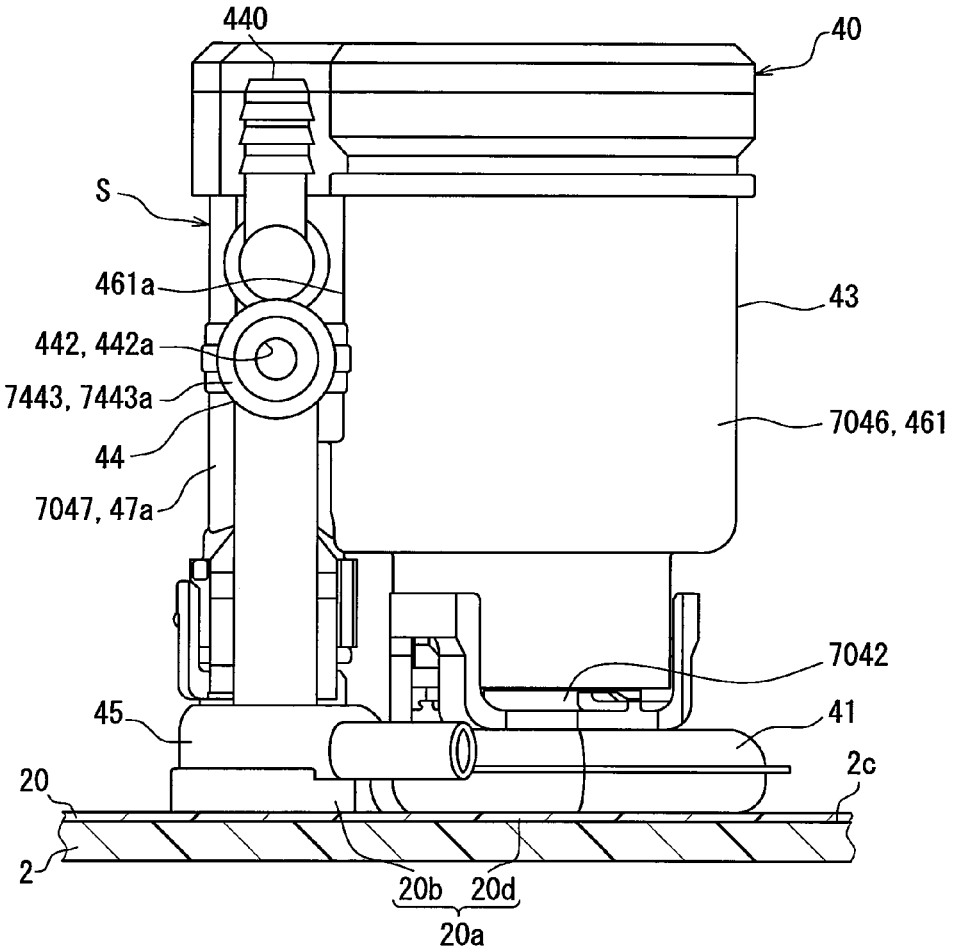
FIG. 18 is a partial cross-sectional view showing a fuel supply device of FIG. 15.

In the seventh embodiment shown in FIGS. 16 and 18 as well, a relief valve 7443, which is a spring-biased type check valve, is disposed in the relief port 442. The relief valve 7443 in the relief port 442 is in communication with the fuel passage 7470 through the relief passage 476 which opens at the side surface 47*a* of the protruding portion 7047. In addition, the relief valve 7443 is in communication with the interior space 26 of the subtank 20 through the most-downstream end 442*a* of the relief port 4421. Accordingly, fuel guided from the relief passage 476 to the relief port 442 may be discharged into this space 26. The relief valve 7443 includes a valve retainer 7443*a*, a valve element 7443*b*, and a valve spring 7443*c*.

As shown in FIG. 16, the valve retainer 7443*a* is formed by resin in a cylindrical shape, and is fitting into the port member 44. A most-downstream end 442*a* of the relief port 442, which is downstream from a stepped portion that forms a planar valve seat 7442*s* of the relief port 442, penetrates through the valve retainer 7443*a*.

The valve element 7443*b* is formed by a resin and rubber composite material in a discoid shape, and is coaxially housed within the relief port 442. Due to being housed in this manner, the valve element 7443*b* is able to separate from and seat on the valve seat 7442*s* by reciprocating. Accordingly, the relief valve 7443 opens according to the valve element 7443*b* separating from the valve seat 7442*s*, and closes according to the valve element 7443*b* seating on the valve seat 7442*s*.

The valve spring 7443*c* is formed by metal in a coil shape. The valve spring 7443*c* is coaxially housed within the relief port 442, and is locked by the valve retainer 7443*a*. The valve spring 7443*c* biases the valve element 7443*b* toward the valve seat 7442*s* with a spring reaction force.

Due to such a configuration, the relief valve 7443 opens and closes the fuel passage 7470, which is in communication with the relief port 442 through the relief passage 476. Specifically, regardless of whether the fuel pump 7042 is operating or stopped, the valve element 7443*b* of the relief valve 7443 is closed by the spring reaction force of the valve spring 7443*c* as long as a fuel delivery path from the fuel passage 7470 to the internal combustion engine 3 remains in a normal state and a pressure of the relief port 442 is less than a relief pressure. During this closed period, fuel, which is pressure adjusted by the operation of the fuel pump 7042, is discharged through the discharge passage 472 in the filter case 43 and through the discharge port 440 outside the filter case 43, and becomes a supply fuel toward the internal combustion engine 3. Conversely, regardless of whether the fuel pump 7042 is operating or stopped, the valve element 7443*b* resists the spring reaction force and opens if an abnormality occurs in the fuel delivery path from the fuel passage 7470 to the internal combustion engine 3 and fuel at or above the relief pressure is guided by the relief port 442. During this open period, the valve element 7443*b* is elastically supported by the valve spring 7443*c*, and the fuel guided to the relief valve 7443 is discharged into the interior space 26 of the subtank 20, and thereby is released until the pressure of the supply fuel to the internal combustion engine 3 becomes the relief pressure. In other words, the opened relief valve 7443 exhibits a relief function on the supply fuel to the internal combustion engine 3. Further, the relief pressure of the relief function of the relief valve 7443 is set to be, e.g., 650 kPa.

Thus far, according to the seventh embodiment, the same operation effects as the first embodiment may be exhibited. In addition to that, according to the seventh embodiment, the external residual pressure retention valve 7473 is a springless type that includes the valve element 478 which, when the fuel pump 7042 is in operation, opens and is locked by the valve stopper 7479. As a result, even if pressure oscillations are generated by the fuel pump 7042 pumping fuel, it is difficult for the valve element 478, which is in a locked state, to vibrate.

Furthermore, the internal residual pressure retention valve 7475 is a spring-biased type including the valve element 7475*b* which, when the fuel pump 7042 is operating, resists a spring reaction force and opens. Here, in the fuel passage 7470 which allows discharge fuel to flow from the discharge port 440, the communication port 7470*e*, which is in communication with the housing chamber 463 at a location downstream from the fuel filter 464, opens at the location R which is a position offset from the internal residual pressure retention valve 7475 toward the external residual pressure retention valve 7473. Due to this, the length L of the internal passage portion 7470*g*, which narrows down a fuel flow from the communication port 7470*e* toward the valve 7475 more than as compared to the external passage portion 7470*f* in which fuel flows from the communication port 7470*e* toward the valve 7473, may be increased so as to satisfy the above equation L/D≥3. As a result, the pressure oscillations generated due to the fuel pumping from the fuel pump 7042 may be attenuated at the internal passage portion 7470*g* which is long and narrowed down until toward the spring-biased type valve 7475. Accordingly, the vibrations of the valve element 7475*b* in this valve 7475 may also be attenuated.

Due to the above, in either of the residual pressure retention valves 7473, 7475, pressure oscillations may be suppressed from increasing due to vibrations of the valve elements 478, 7475*b*. Accordingly, noise generated in the path from the fuel passage 7470 until the internal combustion engine 3 may be reduced.

Further, according to the seventh embodiment, the communication port 7470*e*, which is relayed with the housing chamber 463 by the relay passage 7465, opens at the offset location R. Accordingly, regarding the internal passage portion 7470*g* in which a fuel flow narrows down from the communication port 7470*e* toward the valve 7475, not only can the length L be increased so as to satisfy the equation L/D≥3, the length of the relay passage 7465 from the housing chamber 463 to the communication port 7470*e* may also be increased. As a result, the pressure oscillations generated by pumping of fuel by the fuel pump 7042 may be reduced in the long relay passage 7465 and the long narrow internal passage portion 7470*g* before reaching the spring-biased type valve 7475. Consequently, the noise reduction effect may be improved.

Further, according to the seventh embodiment, the communication port 7470*e*, which opens to the external passage portion 7470*f* at the offset location R, is in communication with the internal passage portion 7470*g* through this passage portion 7470*f*. Here, the fuel flow in the internal passage portion 7470*g* is narrowed down as compared to the external passage portion 7470*f*. Accordingly, a fuel flow rate may be ensured to flow in the external passage portion 7470*f* in order to discharge toward the internal combustion engine 3, and pressure oscillations in the internal passage portion 7470*g* may be attenuated to reduce noise. Further, the internal passage portion 7470*g* opens at the spaced location Q in the external passage portion 7470*f* which interposes the valve 7475 from the relay passage 7465. For this reason, a distance from the communication port 7470*e* to this location Q in the same passage 7470*f* may be increased along with the length of the relay passage 7465. As a result, the previously mentioned pressure oscillations may be reduced at the long relay passage 7465, between each of the locations R, Q where a distance is assured, and the long narrow internal passage portion 7470*g*. Consequently, the noise reduction effect may be improved.

Further, according to the seventh embodiment, the flow direction of fuel in the relay passage 7465 is inclined with respect to the flow direction of fuel in the internal passage portion 7470*g*. Due to this, the fuel flow from the relay passage 7465 through the external passage portion 7470*f* toward the internal passage portion 7470*g* is smoothly turned back, and it is difficult for this fuel flow to separate from the inner wall surface forming these passage portions 7470*f*, 7470*g*. Consequently, it is possible to suppress a source of noise caused by a negative pressure from such a fuel flow separating.

Further, according to the seventh embodiment, fuel, which is diverted from a flow in the fuel passage 7470 toward the internal combustion engine 3, is guided by the relief passage 476. Accordingly, the relief valve 7443 releases the pressure of supply fuel to the internal combustion engine 3. Due to this relief function, the durability of the internal combustion engine 3 may be ensured. Further, in the relief valve 7443 which is a spring-biased type that opens due to the valve element 7443*b* resisting the spring reaction force in order to release the pressure, fuel is guided from downstream of the external residual pressure retention valve 7473 in the fuel passage 7470 through the relief passage 476. Due to this, the distance from the communication port 7470*e* through the fuel passage 7470 and the relief passage 476 until the valve 7443 is increased, and thereby pressure oscillations due to fuel pumping by the fuel pump 7042 may be attenuated. Consequently in the valve 7443, it is possible to suppress the pressure oscillations from increasing due to the vibration of the valve element 7443*b*, and as a result, it is possible to improve the reduction effect of noise generated in the path from the fuel passage 7470 to the internal combustion engine 3.

Further, discharge fuel from the internal passage portion 7470*g*, which is long and narrow to satisfy the equation L/D≥3, passes through the valve 7475 and is further narrowed down and discharged by the jet pump 45 of the seventh embodiment. Accordingly, fuel in the fuel tank 2 is transferred to the vicinity of the fuel pump 7042. Due to this, the jet pump 45 may discharge fuel having pressure oscillations which were attenuated in the internal passage portion 7470*g*, and therefore the fuel transfer function may be exhibited in a stable manner, and it is possible to suppress the generation of noise, which is painful to the ears of a human, caused by intermittent fuel discharge.

Eighth Embodiment

Figure 22:
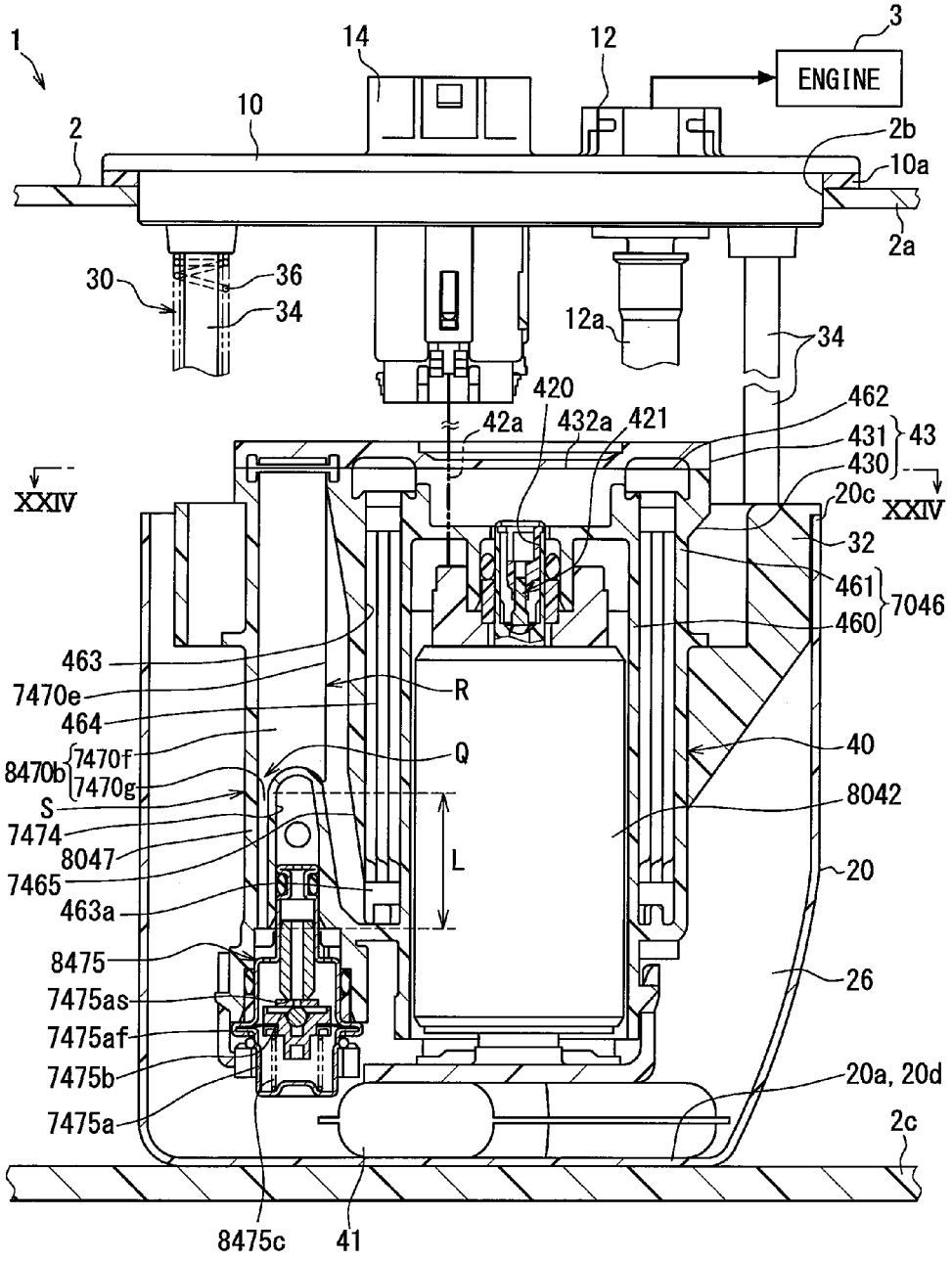
FIG. 22 shows a fuel supply device according to an eighth embodiment, and is a cross-sectional view along XXII-XXII of FIG. 24.

An eighth embodiment of the present disclosure, as shown in FIG. 22, is a modified example of the seventh embodiment. The pressure of the pressurized fuel discharged from a fuel pump 8042 of the eighth embodiment is fixed at, e.g., 400 kPa.

Figure 23:
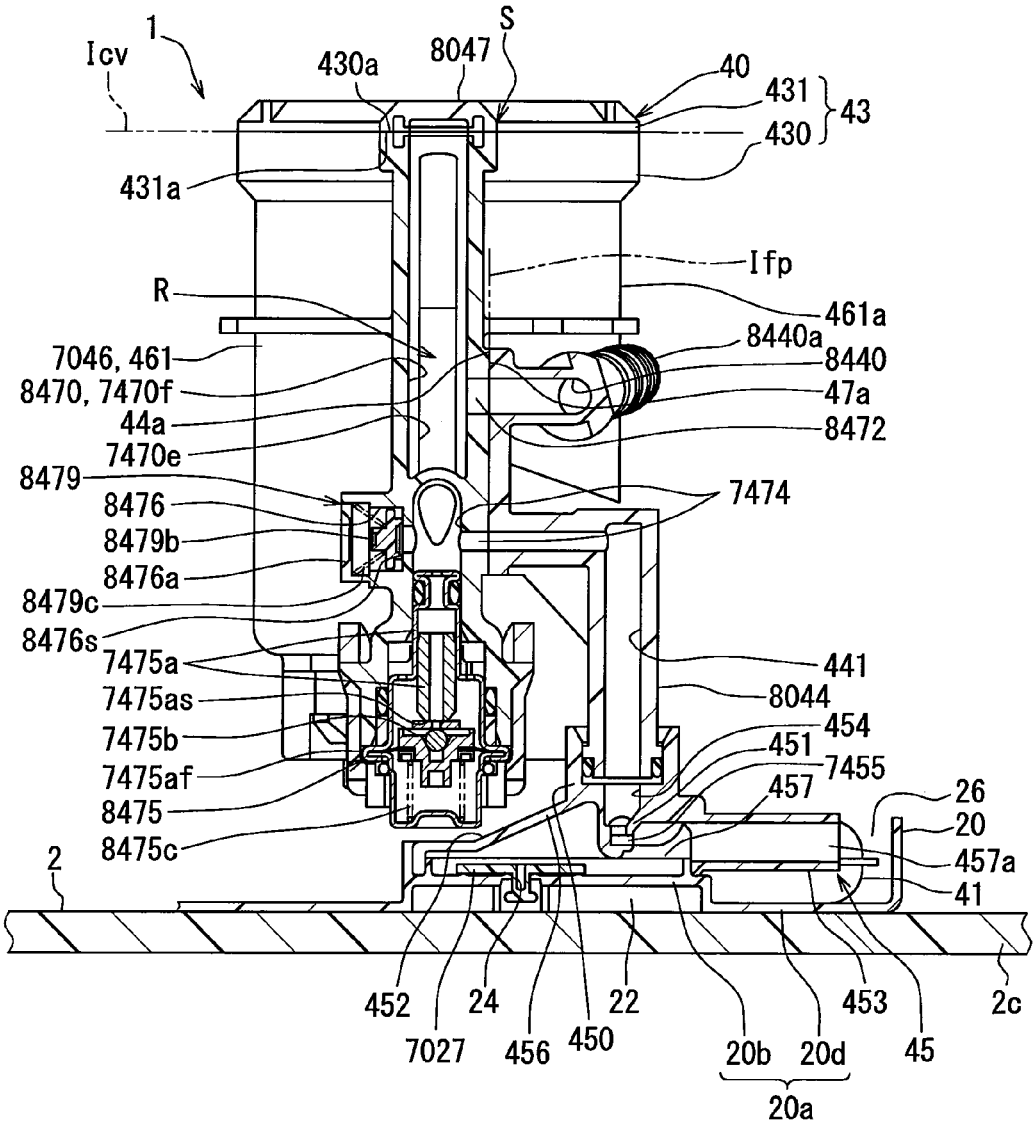
FIG. 23 shows a pump unit of FIG. 22, and is a cross-sectional view along XXIII-XXIII of FIG. 24.
Figure 24:
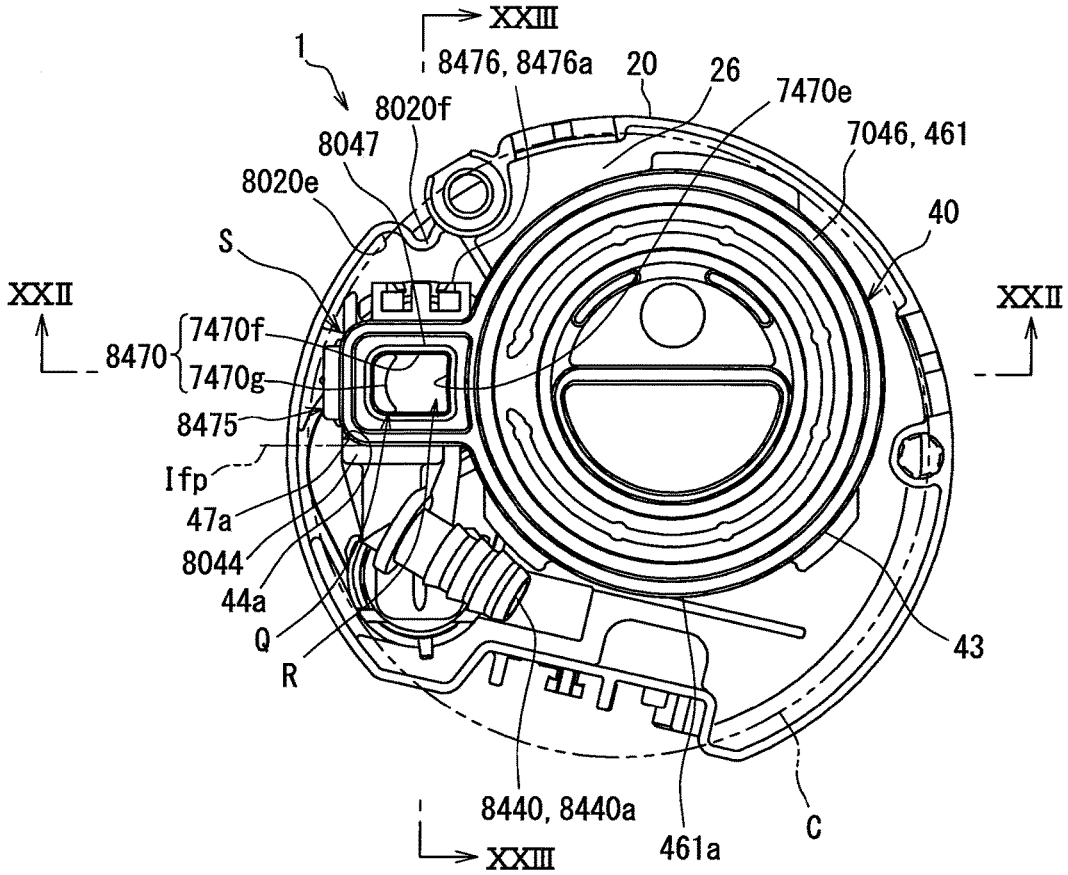
FIG. 24 is a cross-sectional view along XXIV-XXIV of FIG. 22.

Further, as shown in FIGS. 22 to 24, a fuel passage 8470 of the eighth embodiment is formed as a straight, substantially rectangular shaped hole so as to extend linearly along a protruding portion 8047 in the up and down direction toward the axial direction of the filter case 43. The communication port 7470*e* is formed to open at a middle portion of the fuel passage 8470 in the up and down direction. By communicating the communication port 7470*e* with the housing chamber 463 through the relay passage 7465 of FIG. 22, the fuel passage 8470 is positioned downstream from the fuel filter 464. Due to this positioning, the pressurized fuel guided through the relay passage 7465 is discharged from the communication port 7470*e* into the fuel passage 8470.

In this manner, the external passage portion 7470*f* and the internal passage portion 7470*g*, which are formed in the fuel passage 8470, are housed in a protruding portion 8047 along with the elements 8472, 7474, 8475, 8476, 8479 at the specific location S shown in FIGS. 22 to 24. Here, in the external passage portion 7470*f* of the eight embodiment, in which the partition wall 471 and the external residual pressure retention valve 7473 re not provided, guided fuel from the communication port 7470*e* flows toward a discharge passage 8472 which is above the same port 7470*e*. Further, an internal residual pressure retention valve 8475 is disposed to be spaced downward from the discharge passage 8472. In this configuration, the communication port 7470*e* opens at the location R which is a position offset from this valve 8475 toward the discharge passage 8472. Further, as shown in FIGS. 22 and 24, the opening of the internal passage portion 7470*g* is disposed at the spaced location Q in the external passage portion 7470*f*, the spaced location Q being spaced radially outward from the relay passage 7465 to interpose the internal residual pressure retention valve 8475.

Further, regarding the fuel passage 8470, aside from the configurations described above, the fuel passage 8470 conforms to the configuration of the fuel passage 7470 described in the seventh embodiment. Accordingly, in the eighth embodiment as well, the passage diameter D of the cylindrical pipe P virtualized from the passage cross-sectional area of the internal passage portion 7470*g*, and the length L of the internal passage portion 7470*g* from the external passage portion 7470*f* until the internal residual pressure retention valve 7475 (see FIG. 22), satisfy the equation $L/D \geq 3$.

As shown in FIG. 23, the discharge passage 8472 of the eighth embodiment is disposed in a middle region of the protruding portion 8047 in the up and down direction, and is formed as a cylindrical shape positioned above the communication port 7470*e*. The discharge passage 8472 branches from a location downstream from the communication port 7470*e* in the external passage portion 7470*f* of the fuel passage 8470, and branches in a direction perpendicular to the axial direction of the filter case 43. Further, regarding the discharge passage 8472, aside from the configurations described above, the discharge passage 8472 conforms to the configuration of the discharge passage 472 described in the first embodiment.

As shown in FIGS. 22 and 23, in the eighth embodiment, regarding a valve spring 8475*c*, which along with the elements 7475*a*, 7475*b* configure the internal residual pressure retention valve 8475 which acts as one of "a plurality of opening and closing valves", a spring reaction force setting is different from the seventh embodiment. Due to this, when the internal residual pressure retention valve 8475 is open, the pressure of the pressurized fuel from the external passage portion 7470*f* toward the discharge passage 8472 is regulated to, e.g., 400 kPa. At this time, the pressurized fuel flowing from the internal passage portion 7470*g* into the branch passage 7474 flows toward the jet pump 45 and a relief valve 8479. However, this flow is stopped when the internal residual pressure retention valve 8475 is closed. As a result, a retention pressure due to a residual pressure retention function of the closed internal residual pressure retention valve 8475 is, e.g., 400 kPa. Further, regarding the internal residual pressure retention valve 8475, aside from the configurations described above, the internal residual pressure retention valve 8475 conforms to the configuration of the internal residual pressure retention valve 7475 described in the seventh embodiment.

As shown in FIG. 23, a relief passage 8476 of the eighth embodiment is formed as a stepped cylindrical shaped hole at a central portion of the protruding portion 8047 in the up and down direction positioned between the discharge passage 8472 and the internal residual pressure retention valve 8475. The relief passage 8476 branches from a location in the branch passage 7474 downstream from the internal residual pressure retention valve 8475 in a direction perpendicular to the axial direction of the filter case 43, and is connected to a relief valve 8479 at an opposite side from this branching location. Due to being in communication in this manner, the relief passage 8476 guides fuel, which is discharged from the internal passage portion 7470*g* through the internal residual pressure retention valve 8475, to the relief valve 8479.

The internal residual pressure retention valve 8475 acts as another one of "a plurality of opening and closing valves". The relief valve 8479 of the eighth embodiment, which is a spring-biased type check valve, is disposed in the relief passage 8476. The relief valve 8479 is in communication with the interior space 26 of the subtank 20 through the relief passage 8476, and thereby may discharge the fuel guided in the same passage 8476 into this space 26. The relief valve 8479 includes a valve element 8479*b* and a valve spring 8479*c*.

The valve element 8479*b* is formed by a resin and rubber composite material in a discoid shape. The valve element 8479*b* is coaxially housed within the a most-downstream end 8476*a* of the relief passage 8476 which is downstream from a stepped portion that forms a planar valve seat 8476*s*. Due to being housed in this manner, the valve element 8479*b* may separate from and seat on the valve seat 8476*s* by reciprocating. Accordingly, the relief valve 8479 opens according to the valve element 8479*b* separating from the valve seat 8476*s*, and closes according to the valve element 8479*b* seating on the valve seat 8476*s*.

The valve spring 8479*c* is formed by metal in a coil shape, and is coaxially locked in the relief passage 8476. The valve spring 8479*c* biases the valve element 8479*b* toward the valve seat 8476*s* using a spring reaction force.

Due to being structured in this manner, the relief valve 8479 opens and closes the fuel passage 8470, which is in communication with the relief passage 8476 through the branch passage 7474. Specifically, regardless of whether a fuel pump 8042 is operating or stopped, when the internal residual pressure retention valve 8475 closes and the pressure of the relief passage 8476 is below a relief pressure, the valve element 8479*b* of the relief valve 8479 is closed by the spring reaction force of the valve spring 8479*c*. During this closed period, the internal residual pressure retention valve 8475 is also in a closed state, thus fuel does not flow toward the jet pump 45. Conversely, if the fuel pump 8042 is operating, causing the internal residual pressure retention valve 8475 to open, and fuel at or above the relief pressure from the internal passage portion 7470*g* is discharged by this valve 8475, the valve element 8479*b* resists the spring reaction force and opens. During this open period, the valve element 8479*b* is elastically supported by the valve spring 8479*c*, and fuel from the internal passage portion 7470*g* passes through the internal residual pressure retention valve 8475 and is discharged into the interior space 26 of the subtank 20. As a result, the pressure of the fuel heading toward the jet pump 45 is released until reaching the relief pressure. In other words, a relief function is exhibited by the open relief valve 8479 on the discharge fuel from the fuel passage 8470 due to the internal residual pressure retention valve 8475. Further, the relief pressure of the relief function of the relief valve 8479 is set to be, e.g., 50 kPa.

Here, in the eighth embodiment shown in FIG. 24, the most-downstream end 8476*a* of the relief passage 8476 opens in a form facing an inner circumferential surface 8020*e* of the subtank 20 that houses the pump unit 40 including the fuel pump 8042, the filter case 43, and the like. The fuel discharged from the relief valve 8479 flows through the most-downstream end 8476*a* of such a relief passage 8476 and flows into the interior space 26 of the fuel tank 20. Here, since the flow of discharge fuel from the relief valve 8479 through the most-downstream end 8476*a* is released in a horizontal direction, the inner circumferential surface 8020*e* of the subtank 20 protrudes in a mountain shape at a location facing this most-downstream end 8476*a* to form a flow straightening portion 8020*f*.

Figure 25:
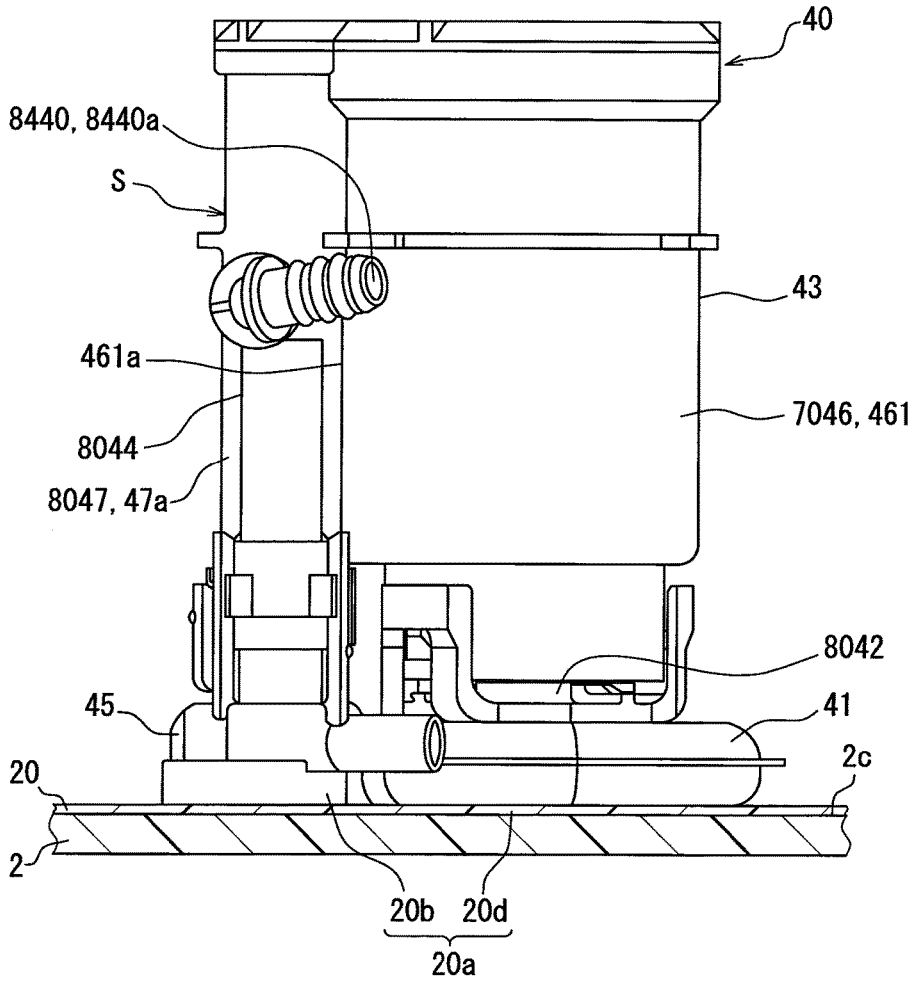
FIG. 25 is a partial cross-sectional view showing a fuel supply device of FIG. 22.

As shown in FIGS. 23 to 25, a port member 8044 of the eighth embodiment integrally includes a discharge port 8440 and the jet port 441 outside of the filter case 43. In other words, the relief port 442 and the relief valve 7443 are not disposed in the port member 8044. In this regard, the discharge port 8440 in the port member 8044 functions as one of "a plurality of fuel ports". Because of this function, the discharge port 8440 is formed to bend along the outer circumferential surface 461*a* of the outer cylindrical portion 461 of the filter case 43, which is curved in a cylindrical surface shape, with a most-downstream end 8440*a* pointing in the horizontal direction, thereby communicating with the flexible tube 12*a* (refer to FIG. 22). Here, the horizontal direction in which the most-downstream end 8440*a* of the discharge port 8440 points toward is a direction perpendicular to the axial direction of the filter case which lies along the up and down direction, and is slightly inclined upward. Further, the discharge port 8440 is connected with the discharge passage 8472, which opens at the side surface 47*a* of the protruding portion 8047, at an opposite side from the most-downstream end 8440*a*, as shown in FIG. 23. In addition, regarding the port member 8044 and the discharge port 8440, aside from the above explanations, the configuration of the port member 8044 and the discharge port 8440 conforms to the configuration of the port member 44 and the discharge port 440 described in the first embodiment.

According to such an eighth embodiment, the internal residual pressure retention valve 8475, which retains the fuel pressure of the housing chamber 463 when the fuel pump 8042 is stopped, is a spring-biased type including the valve element 7475*b*, which resists a spring reaction force to open when the fuel pump 8042 is operating. Here, in the fuel passage 8470 which allows discharge fuel from the discharge port 8440, which is in communication with the discharge passage 8472, to flow toward the internal combustion engine 3, the communication port 7470*e*, which is in communication with the housing chamber 463 at a location downstream from the fuel filter 464, opens at the offset location R, which is a location offset from the valve 8475 toward this passage 8472. Accordingly, in the fuel passage 8470, the length L of the internal passage portion 7470*g*, which narrows down a fuel flow from the communication port 7470*e* toward the valve 8475 more than as compared to the external passage portion 7470*f* in which fuel flows from the communication port 7470*e* toward the passage 8472, may be increased as compared so as to satisfy the above equation $L/D \geq 3$. As a result, the pressure oscillations generated due to the fuel pumping from the fuel pump 8042 may be attenuated at the internal passage portion 7470*g* which is long and narrowed down until toward the spring-biased type valve 8475. Accordingly, the vibrations of the valve element 7475*b* in this valve 8475 may also be attenuated.

Due to the above, in the internal residual pressure retention valve 8475, it is possible to suppress pressure oscillations from increasing due to vibrations of the valve element 7475*b*. Accordingly, noise generated in the path from the fuel passage 8470 until the internal combustion engine 3 may be reduced.

Further, according to the eighth embodiment, the pressure of the fuel discharged from the internal passage portion 7470*g* through the internal residual pressure retention valve 8475 is released by the relief valve 8479 even if this pressure rises due to, for example, a narrowing effect on this discharge fuel at the jet pump 45. Due to such a relief function, the pressure regulating function of the valve 8475, which regulates the pressure of the fuel toward the discharge passage 8472, i.e., the pressure of the fuel discharged toward the internal combustion engine 3, may be exhibited in a stable manner. Further, fuel from the internal passage portion 7470*g* passes through the valve 8475 to reach the valve 8479 which is a spring-biased type in which the valve element 8479*b* resists the spring reaction force to open in order to release pressure. Due to this, besides the effect of the passage portion 7470*g* which is long and narrow to satisfy the equation $L/D \geq 3$, the pressure oscillations due to the fuel pumping of the fuel pump 8042 may be attenuated by the distance from the communication port 7470*e* through the fuel passage 8470 until the valve 8479 becoming longer. Consequently, in the valve 8479, it is possible to prevent the pressure oscillations from increasing due to vibrations of the valve element 8479*b*, and therefore the reduction effect on noise generated in the path from the fuel passage 8470 until the internal combustion engine 3 may be improved.

Further, according to the eighth embodiment, the port member 8044 is connected to the specific location S in the filter case 43 that includes the outer circumferential surface 461*a* which is curved in a curved surface shape. Accordingly, the port member 8044 forms the discharge port 8440 along this surface 461*a*. As a result, the diameter of a circumscribing circle C that contacts both the outer circumference of the filter case 43 and the outer circumference of the port member 5044 may be reliably decreased, and the miniaturization of the device 1 in the radial direction of the filter case 43 may be facilitated.

Further, according to the eighth embodiment, the most-downstream end 8476*a* of the relief passage 8476, which opens toward the inner circumferential surface 8020*e* of the subtank 20, faces the flow straightening portion 8020*f* of the same tank 20. Due to this, the flow of fuel discharged from the relief valve 8479 through the most-downstream end 8476*a* of the relief passage 8476 is released in a horizontal direction, and therefore it is possible to suppress the fuel from overflowing from the top portion of the subtank 20.

In addition, aside from the above discussed operation effects of the eighth embodiment, the same operation effects as the first and seventh embodiments may be exhibited.

Further, according to the eighth embodiment, the most-downstream end 8440*a* of the discharge port 8440 faces in a horizontal direction. Due to this configuration, it suffices even if a space for positioning, e.g., the flexible tube 12*a*, which acts as a path for flowing fuel from the discharge port 8440 toward the internal combustion engine 3, is not ensured directly above this port 8440. Due to this, the device 1 may be miniaturized in the up and down direction, for example, the device 1 may be applied to a low-floor type fuel tank 2.

In addition, aside from the above discussed operation effects of the eighth embodiment, the same operation effects as the first and seventh embodiments may be exhibited.

Other Embodiments

Above, a plurality of embodiments of the present disclosure are discussed, but the present disclosure is not interpreted as being limited to these embodiments, and a variety of embodiments and combinations may be applied in a range without departing from the gist of the present disclosure.

Specifically, as a first modified example related to the first to eighth embodiments, the filter case 43, 2043, 3043, 4043, 6043 and the port member 44, 4044, 5044, 8044 may be joined, e.g., in a stepped manner at a location other than the imaginary plane Ifp.

As a second modified example related to the first to seventh embodiments, the external residual pressure retention valve 473, 2473, 3473, 6473, 7473 may be disposed in the discharge port 440, 5440. Further, As a third modified example related to the first to seventh embodiments, the internal residual pressure retention valve 475, 7475, 8475 may be disposed in the jet port 441, 5441.

As a fourth modified example related to the fourth to sixth and eighth embodiments, the relief port 442 which is connected to the relief passage 4476, 8476 conforming to the first and seventh embodiments and which includes the relief valve 4443, 8479 may be formed in the port member 4044, 5044, 8044. Further, as a fifth modified example related to the first to eighth embodiments, the relief valve 443, 4443, 7443, 8479 may be not provided.

As a sixth modified example related to the first to eighth embodiments, the jet pump 45 may be not provided. In this case, the port 441 may be formed, or may be not formed, in the port member 44 as the sixth modified example related to the first to third and seventh embodiments. Further, as a seventh modified example related to the first to third and seventh embodiments, without forming the discharge port 440 in the port member 44, the discharge passage 472 may be directly communicated with the flexible tube 12*a*. Further, as an eighth modified example related to the first to third and seventh embodiments, without forming the jet port 441 in the port member 44, the branch passage 474, 7474 may be directly communicated with the jet pump 45.

As a ninth modified example related to the first to eighth embodiments, the jet port 441, 5441 may be formed above the discharge port 440, 5440, 8440. Further, as a tenth modified example related to the first to eighth embodiments, the port member 44, 4044, 5044, 8044 maybe disposed in an offset manner from the flow inlet 24 in the axial direction of the filter case 43, 2043, 3043, 4043, 6043.

As an eleventh modified example related to the first to third and seventh embodiments, conforming to the fourth embodiment, without forming the relief port 442 in the port member 44, the relief valve 443, 7443 may be disposed in the relief passage 476. Further, As a twelfth modified example related to the first to fourth and sixth to eighth embodiments, conforming to the fifth embodiment, the ports 440, 441, 442 may be formed along the outer circumferential surface 461*a*.

As a thirteenth modified example related to the seventh and eighth embodiments, without disposing the relay passage 7465 in the filter case 43, the fuel outlet 463*a* of the housing chamber 463 may be substantially coincided with the communication port 7470*e*. Further, as a fourteenth modified example related to the seventh and eighth embodiments, the flow direction of the fuel in the relay passage 7465 may be set to be substantially perpendicular or substantially parallel to the flow direction of fuel in the internal passage portion 7470*g*.

As a fifteenth modified example related to the seventh and eighth embodiments, the internal residual pressure retention valve 7475, 8475 is disposed at the spaced location Q which is spaced away from the relay passage 7465 to interpose the internal passage portion 7470*g*, and the internal passage portion 7470*g* may be opened at a location in the external passage portion 7470*f* which is closer to the relay passage 7465 than this spaced location Q. Further, as a sixteenth modified example related to the seventh and eighth embodiments, by opening the communication port 7470*e* at an offset location R in the internal passage portion 7470*g*, the external passage portion 7470*f* may be communicated with the communication port 7470*e* through the internal passage portion 7470*g*.

As a seventeenth modified example related to the seventh and eighth embodiments, in a configuration where the protruding portion 7047, 8047 is not provided, a non-housing section that does not house the fuel filter 464 may be provided at a portion of the filter case 43 in the circumferential direction, and this non-housing portion may be set at the specific location S. Further, as an eighteenth modified example related to the seventh embodiment, at least one of the external residual pressure retention valve 7473 and the internal residual pressure retention valve 7475 may be disposed in a section of the filter case 43 other than the protruding portion 7047 at the specific location S.

As a nineteenth modified example related to the eighth embodiment, at least one of the internal residual pressure retention valve 8475 and the discharge passage 8472 may be disposed in a section of the filter case 43 other than the protruding portion 8047 at the specific location S. Further, as a twentieth modified example related to the eighth embodiment, the flow straightening portion 8020*f* may be not provided. Further, as a twenty first modified example related to the eighth embodiment, conforming to the first embodiment, the most-downstream end 8440*a* of the discharge port 8440 may point upward.

As a twenty second modified example related to the first to seventh embodiments, conforming to the eighth embodiment, the most-downstream end of the discharge port 440, 5440 may be pointed in a horizontal direction. Further, as a twenty third modified example related to the first to eighth embodiments, the relief valve 443, 4443, 7443, 8479 of an electromagnetic type, e.g., solenoid valves of the like, may be provided.

As a twenty fourth modified example related to the first to eighth embodiments, fuel other than that which is discharged from the fuel passage 470, 4470, 7470, 8470 through the internal residual pressure retention valve 475, 7475, 8475 may be sprayed out at the jet pump 45. For example, discharge fuel from the fuel pump 42, 7042, 8042, return fuel from the internal combustion engine 3, or the like may be used as fuel which is sprayed out by such a jet pump 45. Further, as a twenty fifth modified example related to the first to third and seventh embodiments, a divided port member 44 corresponding to one and two of the ports 440, 441, 442 may be used.

The invention claimed is:

1. A fuel supply device, comprising:

a fuel pump;

a filter case that houses a fuel filter; and a port member joined to the filter case, wherein a fuel pumped by the fuel pump from inside a fuel tank is filtered by the fuel filter and supplied from inside the filter case toward an internal combustion engine, and the port member integrally includes a plurality of fuel ports that communicate from inside of the filter case to outside of the filter case wherein the port member forms, as one of the fuel ports, a discharge port that discharges fuel in the filter case toward the internal combustion engine outside the filter case, the filter case has disposed therein a fuel passage including a communication port, the communication port being in communication with a housing chamber in the filter case, which houses the fuel filter, at a location downstream from the fuel filter, the fuel passage allowing fuel to flow from the communication port, an external residual pressure retention valve having a valve element that, when the fuel pump is operating, opens and becomes locked by a valve stopper, the external residual pressure retention valve being a spring-less type external residual pressure retention valve that, when the fuel pump is stopped, retains a pressure of the fuel discharged from the discharge port toward the internal combustion engine, and an internal residual pressure retention valve having a valve element that, when the fuel pump is operating, resists a spring reaction force to open, the internal residual pressure retention valve being a spring-biased type residual pressure retention valve that, when the fuel pump is stopped, retains a pressure of the fuel in the housing chamber, the communication port opens at an offset location in the fuel passage, the offset location being offset from the internal residual pressure retention valve toward the external residual pressure retention valve, the fuel passage has formed therein an external passage portion that allows fuel, which is for being discharged by the discharge port toward the internal combustion engine, to flow from the communication port toward the external residual pressure retention valve, and an internal passage portion that allows fuel to flow from the communication port toward the internal residual pressure retention valve, the internal passage portion narrowing down a fuel flow more than the external passage portion, and when a passage cross-sectional area of the internal passage portion is converted into a passage cross-sectional area of a cylindrical pipe, a passage diameter D of this cylindrical pipe and a length L of the internal passage portion satisfy the equation $L/D \geq 3$.

2. The fuel supply device of claim 1, wherein the filter case and the port member are joined to each other on a common imaginary plane.

3. The fuel supply device of claim 1, wherein the filter case includes an outer circumferential surface curved in a curved surface shape, and the port member forms the each fuel port along the outer circumferential surface.

4. The fuel supply device of claim 1, wherein the port member forms, as one of the fuel ports, a discharge port that discharges fuel inside the filter case toward the internal combustion engine outside of the filter case.

5. The fuel supply device of claim 4, further comprising:

a jet pump which is outside the filter case, the jet pump transferring fuel inside the fuel tank to a vicinity of the fuel pump by spraying out fuel discharged from inside the filter case, wherein the port member forms, as one of the fuel ports, a jet port that guides discharge fuel from inside the filter case to the jet pump, the jet port being formed below the discharge port.

6. The fuel supply device of claim 1, further comprising:

a jet pump which is outside the filter case, the jet pump transferring fuel inside the fuel tank to a vicinity of the fuel pump by spraying out fuel discharged from inside the filter case, wherein the port member forms, as one of the fuel ports, a jet port that guides discharge fuel from inside the filter case to the jet pump.

7. The fuel supply device of claim 5, further comprising:

a subtank having a closed bottom shape that forms a flow inlet at a bottom portion, fuel transferred by the jet pump from inside the fuel tank flowing into the flow inlet, the subtank storing the transferred fuel that flowed through the flow inlet in the vicinity of the fuel pump, wherein the port member and the jet pump overlap with the flow inlet on the bottom portion in an axial direction of the filter case.

8. The fuel supply device of claim 1, further comprising:

a relief valve having a valve element, the relief valve being a spring-biased relief valve that releases a pressure of fuel supplied toward the internal combustion engine by being discharged from the discharge port, the valve element resisting a spring reaction force to open in order to release this pressure, wherein the filter case includes a relief passage in the fuel passage, the relief passage guiding, to the relief valve, fuel which is diverted, at a location downstream from the external residual pressure retention valve, from a flow toward the internal combustion engine.

9. The fuel supply device of claim 1, wherein the filter case includes a relay passage that relays between the housing chamber and the communication port.

10. The fuel supply device of claim 9, wherein the communication port opens to the external passage portion at the offset location, and the internal passage portion opens to a spaced location in the external passage portion, the spaced location being spaced away from the relay passage to interpose the internal residual pressure retention valve, the internal passage portion thereby communicating with the communication port through the external passage portion.

11. The fuel supply device of claim 10, wherein a flow direction of fuel in the relay passage is inclined with respect to the flow direction of fuel in the internal passage portion, a fuel flow from the relay passage thereby flowing through the external passage portion and turning back toward the internal passage portion.

12. The fuel supply device of claim 1, wherein the communication port opens to the external passage portion at the offset location, thereby communicating with the internal passage portion through the external passage portion.

13. The fuel supply device of claim 1, further comprising:

a jet pump that transfers fuel inside the fuel tank to a vicinity of the fuel pump by narrowing down and spraying out a fuel discharged from the internal passage portion through the internal residual pressure retention valve.

* * * * *